US007664412B2

(12) United States Patent
Taguchi et al.

(10) Patent No.: US 7,664,412 B2
(45) Date of Patent: Feb. 16, 2010

(54) IMAGE FORMING APPARATUS THAT ADJUSTS OPERATING CONDITIONS BASED ON A DENSITY DETECTION RESULT OF A PATCH IMAGE

(75) Inventors: Keiichi Taguchi, Nagano-ken (JP); Masahiro Maeda, Nagano-ken (JP); Isao Inaba, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 691 days.

(21) Appl. No.: 10/585,177

(22) PCT Filed: Aug. 30, 2005

(86) PCT No.: PCT/JP2005/015725

§ 371 (c)(1),
(2), (4) Date: Jun. 29, 2006

(87) PCT Pub. No.: WO2006/025361

PCT Pub. Date: Mar. 9, 2006

(65) Prior Publication Data

US 2009/0175639 A1 Jul. 9, 2009

(30) Foreign Application Priority Data

Sep. 1, 2004 (JP) ..... 2004-254102

(51) Int. Cl.
*G03G 15/00* (2006.01)

(52) U.S. Cl. ..... 399/49; 399/26; 399/50

(58) Field of Classification Search ..... 399/26, 399/49, 50

See application file for complete search history.

(56) References Cited

U.S. PATENT DOCUMENTS

| | | | | |
|---|---|---|---|---|
| 2004/0105689 | A1 | 6/2004 | Shimura et al. | 399/12 |
| 2004/0131370 | A1 | 7/2004 | Yamauchi | 399/24 |

FOREIGN PATENT DOCUMENTS

| | | |
|---|---|---|
| JP | 62-059978 | 3/1987 |
| JP | 02-054281 | 2/1990 |
| JP | 10-039607 | 2/1998 |
| JP | 10-186770 | 7/1998 |
| JP | 2001-154429 | 6/2001 |
| JP | 2001-183878 | 7/2001 |
| JP | 2002-236405 | 8/2002 |
| JP | 2003-330235 | 11/2003 |
| JP | 2003-345073 | 12/2003 |
| JP | 2004-170955 | 6/2004 |
| JP | 2004-177437 | 6/2004 |
| JP | 2004-177928 | 6/2004 |

*Primary Examiner*—David M Gray
*Assistant Examiner*—Ryan D Walsh
(74) *Attorney, Agent, or Firm*—Hogan & Hartson LLP

(57) ABSTRACT

An image forming apparatus and an image forming method, which are capable of forming images at stable image quality by executing adjustment of operating conditions at appropriate timings, are provided. When a Vsync count corresponding to an integrated value of a rotation count of an intermediate transfer belt reaches a predetermined value V1 or V2, a charging current Iw is increased by one level and an adjusting operation of a developing bias is executed (at a time t4 or t5), to thereby stabilize an image density. Further, when remaining service life of a developer reaches a predetermined value (50%) (at a time t6), if the Vsync count at that moment suggests that the time to change the charging current Iw is drawing near, the change thereof is executed ahead of the schedule, whereby the adjusting operation of the developing bias, which should otherwise be executed at the time t7, is omitted.

11 Claims, 18 Drawing Sheets

FIG. 16

| OPC COUNT [$\times 10^3$ cycle] | ESTIMATED FILM THINNING AMOUNT [$\mu$m] | BIAS ADJUSTMENT VALUE [V] |
|---|---|---|
| 0 | 0 | 0 |
| 40 | 1 | −10 |
| 80 | 2 | −20 |
| 120 | 3 | −30 |
| 160 | 4 | −40 |
| 200 | 5 | −50 |
| 240 | 6 | −60 |
| 280 | 7 | −70 |
| 320 | 8 | −80 |
| 360 | 9 | −90 |
| 400 | 10 | −100 |

IMAGE FORMING APPARATUS THAT ADJUSTS OPERATING CONDITIONS BASED ON A DENSITY DETECTION RESULT OF A PATCH IMAGE

TECHNICAL FIELD

The present invention relates to an image forming apparatus and an image forming method, wherein a toner image is formed as a patch image and operating conditions are adjusted based on a density detection result of the patch image.

BACKGROUND ART

The image forming apparatuses, such as copiers, printers, and facsimiles, applying electrophotographic technology, may encounter image density variation of a toner image due to individually different characters of apparatuses, variation over time, changes of conditions surrounding the apparatuses which include temperature, moisture, and the like. Heretofore, a variety of technologies have been proposed for the purpose of ensuring a stable image. Among these technologies, for example, is technology in which a small test image (patch image) is formed on an image carrier and the operating conditions are optimized based on the density of the patch image. In this technology, in order to ensure a stable image quality, the operating conditions are optimized at a predetermined timing. For example, in order to minimize density fluctuation stemming from toner property variation over time, the image forming apparatus described in the patent document #1 memorizes the parameters that indicate the status of toners in a developer and executes a readjustment of operating conditions every time when a parameter reaches a predetermined threshold value.

Patent Document 1: Japanese Patent Application Laid-Open Gazette No. 2004-177928

DISCLOSURE OF THE INVENTION

Problems to be Solved by the Invention

Quality of image that is formed in this kind of apparatus may fluctuate due to numerous factors other than the aforementioned variation in toner properties in the developer. For example, charge property of a latent image carrier may change over time with a progression of contamination and deterioration of a latent image carrier that is disposed to carry electrostatic latent image and a charger unit which charges the latent image carrier. These changes in property cause fluctuations in image quality. The apparatuses applying aforementioned conventional technologies are not suitable to the aforementioned fluctuations, thereby leaving opportunities for improvement in image quality.

Means for Solving the Problems

The present invention is designed to tackle the aforementioned challenges, with the objective of providing an image forming apparatus and image forming method that is capable of forming image with stable image quality.

According to the present invention, to achieve the above-mentioned object, an image forming apparatus comprises: an image forming section which includes a latent image carrier which is constructed to carry an electrostatic latent image and a charger unit which charges the latent image carrier to a predetermined surface potential, wherein an electrostatic image, which is formed on a surface of the latent image carrier, is developed with toner to form a toner image; and a controller unit which performs an adjusting operation to adjust operating conditions of the image forming section based on a density detection result of a toner image which is formed by the image forming section as a patch image, wherein the controller unit has a characteristics of determining execution timing of the adjusting operation based on timing information related to variation over time in charge property of the latent image carrier.

Also, the image forming method in the present invention relates to the image forming method for use in an image forming apparatus which comprises: a latent image carrier which is constructed to be carry an electrostatic latent image; and a charger unit which charges the latent image carrier to a predetermined surface potential, and which develops an electrostatic image, which is formed on a surface of the latent image carrier, with toner so as to form a toner image, to achieve the above-mentioned object, in the method, the toner image is formed as a patch image at timing that is determined based on timing information associated with variation in charge property of the latent image carrier that is charged by the charger unit, which has a characteristic of adjusting operating conditions based on a detected density of the toner image.

According to the present invention, "charge property" is an indicator that indicates a status of charge (charge potential and its uniformity within the surface) the latent image carrier gets as a result of operating the charger unit at a certain operating condition to charge the latent image carrier. The term "charge property" means a concept that embraces the characters inherent to each individual latent image carrier and charger unit, the change in performance due to contamination during usage, as well as the change in charge status in the latent image carrier caused by the combination of the above.

The term "timing information" according to the present invention refers to any parameters that describe directly or indirectly the charge property that changes over time. For example, the information on remaining service life of the latent image carrier or charger unit can be used as such parameter. More specifically, it is possible to count up workload or operation time of the latent image carrier or the charger unit and use the integrated value as timing information. Also, when charge property can be estimated based on the workload of other components of the apparatus, such workload can be used as timing information.

Operating condition can be adjusted at any necessary timing according to the condition of each individual component of the apparatus as well as the aforementioned timing, for example, immediately after the power of the devise is turned on, immediately after recovery from sleep, etc. In this case, the operation process can be differentiated between the adjusting operation triggered by the timing information and the adjusting operations executed at other timings. The reason is; while it is difficult to predict the condition of the apparatus and its surrounding environment immediately after turning of the power supply or recovery from sleep, it is possible to predict over-time change in the charge property to some degree.

Further, in the image forming apparatus that comprises the charger unit with discharging electrode disposed close to the surface of latent image carrier, the arrangement can be made to control charge property of the latent image carrier by adjusting the amount of the current that is supplied to the discharging electrode based on the timing information, as well as to perform the adjusting operation when the amount of current is changed.

Further, in the image forming apparatus, wherein the charger unit comprises an electrode member loaded with predetermined charge bias and a high-resistance layer that is disposed to cover the surface of the electrode and wherein the latent image carrier is charged while the high-resistance layer abutting the latent image carrier, the arrangement can be made for the controller unit to control charge property of the latent image carrier by adjusting the aforementioned charge bias based on timing information as well as to perform an adjusting operation when the aforementioned charge bias is changed.

Effects of the Invention

According to the present invention, the operating conditions of the apparatus are adjusted at an appropriate timing corresponding to the change in the charge property of the latent image carrier which is caused by the charger unit. Hence, the images can be formed at a stable image quality. For example, the arrangement can be made to perform an adjusting operation when the timing information reaches a predetermined threshold value.

Further, when the operation process is differentiated between the adjusting operation triggered by the timing information and the adjusting operation triggered by other factors, the operation can be better optimized. For example, the process of the adjusting operation that is triggered by the timing information can be more simplified than that of the adjusting operation that is performed at other timings. By doing this, the adjusting operation can be completed in shorter time, and toner consumption during the adjusting operation can be minimized.

Further, there is an apparatus, wherein a discharging electrode is disposed close to the surface of the latent image carrier and the amount of current supplied to the discharging electrode is adjusted based on timing information. In the apparatus, the charge property changes in accordance with the change in the amount of current supplied to the discharging electrode. Therefore, adjusting the operating conditions of the apparatus whenever the amount of current is changed will make it possible to minimize fluctuation in the image quality before and after the change in the amount of current.

Further, the present arrangement will deliver the following benefits. An apparatus, wherein current is discharged to the discharging electrode to charge the latent image carrier, faces the challenge of minimizing the amount of current for the purpose of minimizing ozone amount which is entailed by electrical discharge. However, the amount of current too low may entail a risk of causing charge defect in the latent image carrier when the charge property drops due to deterioration in the latent image carrier, contamination in charger unit, etc. In order to resolve this problem, it is desirable to keep initial amount of current low and gradually increase the current as charge property changes over time. However, merely changing the amount of current may still allow the aforementioned fluctuation in image quality before and after the change. Hence, readjusting operating conditions of the apparatus whenever the amount of current is changed can prevent such fluctuations in the image quality. This arrangement will make it possible to obtain images at stable image quality while controlling excessive current that will result in the generation of ozone. Also, it is possible to predict, to some degree, variation in charge property resulting from increase/decrease in the amount of current that flows to the discharging electrode. Hence, the adjusting operation that is executed immediately after changing the amount of current can be simplified as described above.

There is an apparatus wherein the charger unit comes into contact with the latent image carrier to charge the latent image carrier. In the apparatus, a charge bias is changed in accordance with the charge property that changes due to varying thickness of the latent image carrier to stabilize the amount of charge in the latent image carrier, whereby fluctuation in the image quality is suppressed.

BRIEF DESCRIPTION OF THE DRAWINGS

FIG. 16 is a view which shows an example of adjusting a charging bias;

DESCRIPTION OF REFERENCE CHARACTERS

10: engine controller (controller unit)
22: photosensitive member (latent image carrier)
23: charger unit (charger)
23*a*: charger wire (discharging electrode)
77: vertical synchronizing sensor
230: charger unit (charger)
230*a*: surface layer (high-resistance layer)
230*b*: metallic roller (electrode member)
EG: engine section (image forming section)

BEST MODES FOR CARRYING OUT THE INVENTION

First Embodiment

Figure 1:
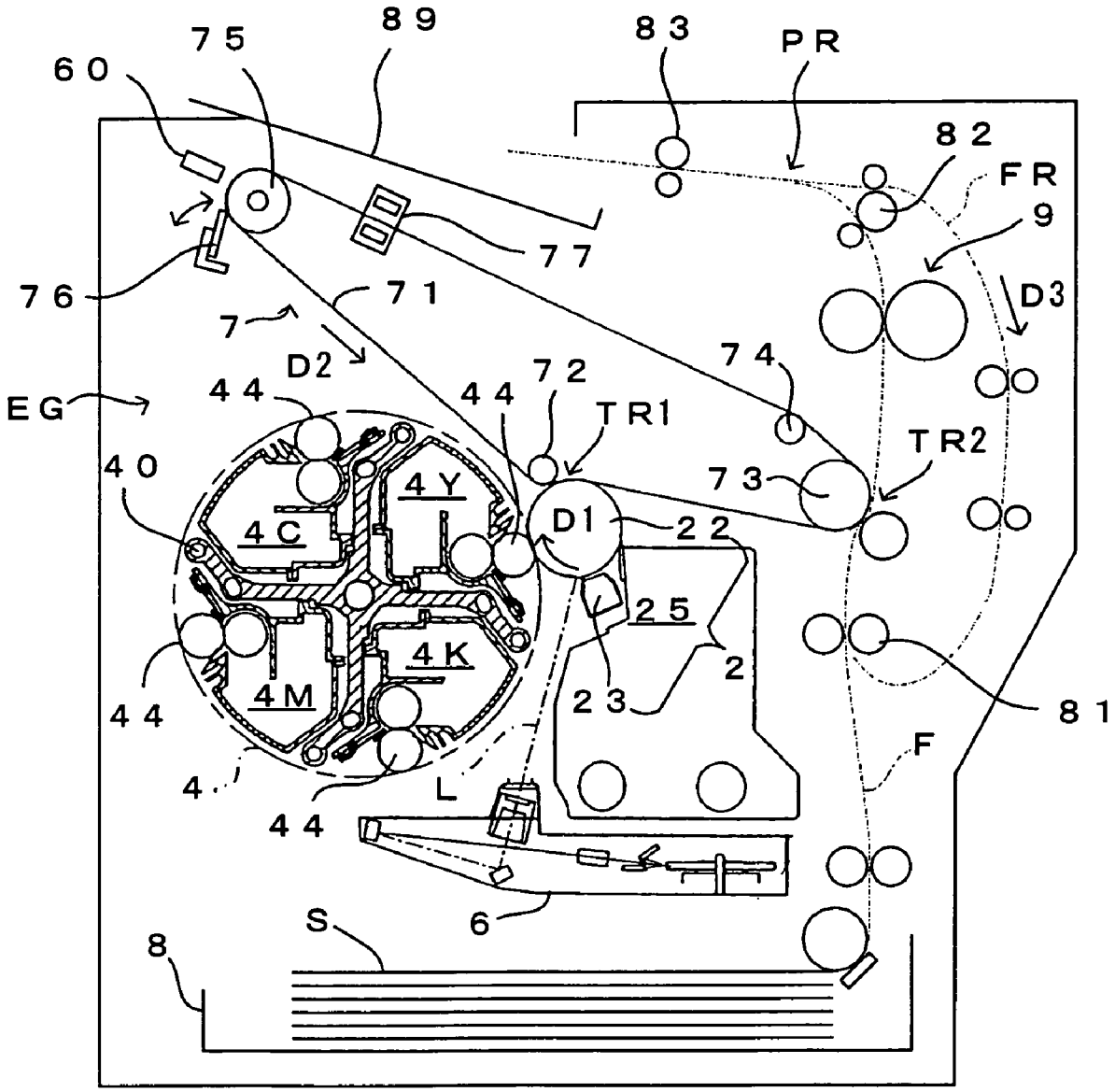
FIG. 1 is a view which shows a structure of an image forming apparatus according to a first embodiment of the present invention.
Figure 2:
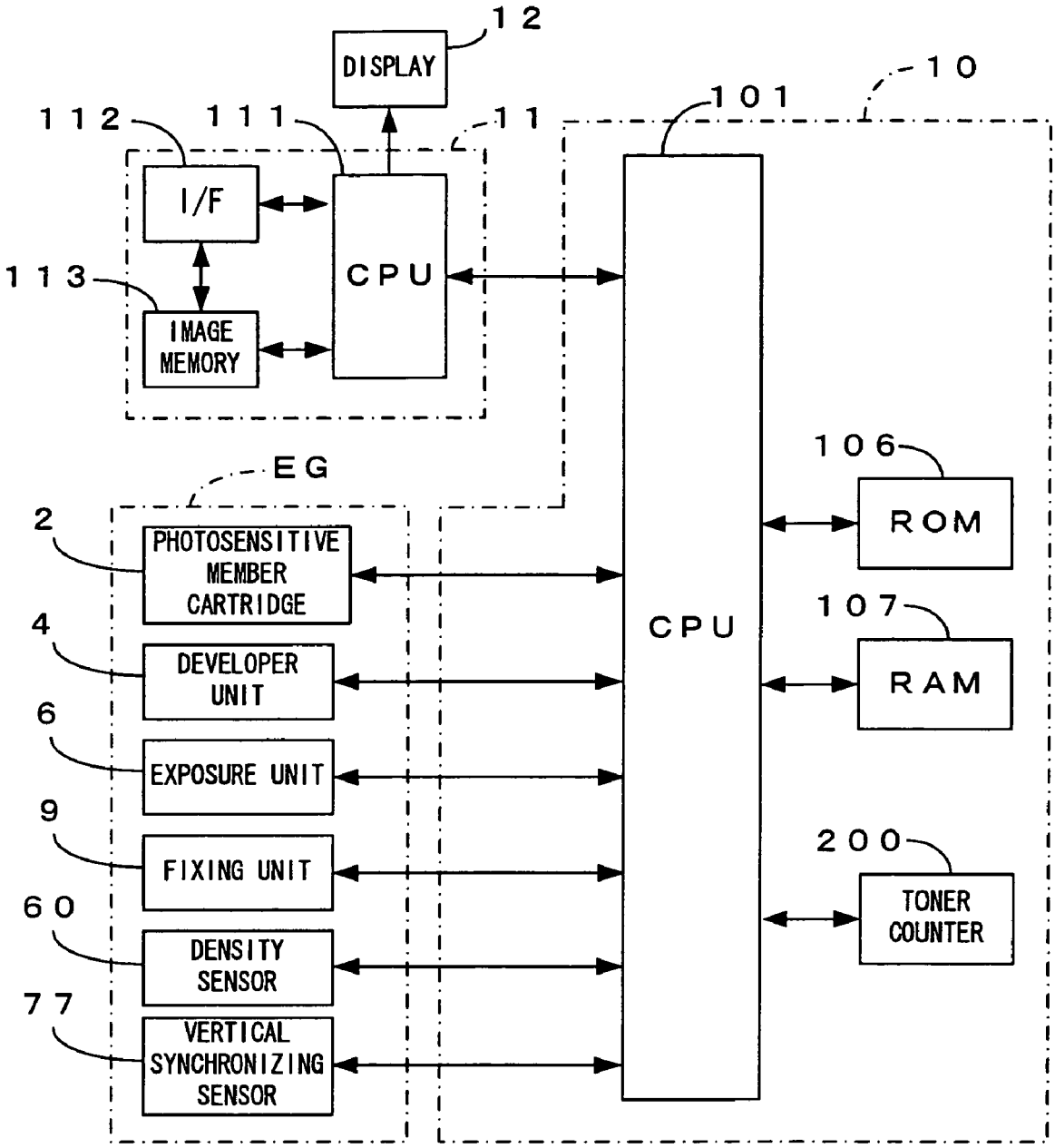
FIG. 2 is a block diagram of an electric structure of the image forming apparatus which is shown in FIG. 1.

FIG. 1 is a drawing which shows the structure of an image forming apparatus according to a first embodiment of the present invention. FIG. 2 is a block diagram of the electric structure of the image forming apparatus which is shown in FIG. 1. The apparatus is an apparatus which overlays toner in four colors of yellow (Y), cyan (C), magenta (M) and black (K) one atop the other and accordingly forms a full-color image, or forms a monochrome image using only black toner (K). In the image forming apparatus, when an image signal is fed to a main controller 11 from an external apparatus such as a host computer, a predetermined image forming operation is performed. That is, a CPU 101 provided into an engine controller 10 controls respective portions of an engine section EG in accordance with an instruction received from the main controller 11, and an image which corresponds to the image signal is formed on a sheet S.

In the engine section EG, a photosensitive member 22 is disposed so that the photosensitive member 22 can freely rotate in the arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a used toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from a main section of the apparatus as one integrated unit.

An exposure unit 6 emits a light beam L toward the outer circumferential surface of the photosensitive member 22 which is thus charged by the charger unit 23. The exposure unit 6 makes the light beam L expose on the photosensitive member 22 in accordance with an image signal fed from the external apparatus and forms an electrostatic latent image which corresponds to the image signal.

The developer unit 4 develops thus formed electrostatic latent image with toner. The developer unit 4 comprises a support frame 40 which is disposed for free rotations about a rotation shaft which is perpendicular to the plane of FIG. 1, and also comprises a yellow developer 4Y, a cyan developer 4C, a magenta developer 4M and a black developer 4K which house toner of the respective colors and are formed as cartridges which are freely attachable to and detachable from the support frame 40. The engine controller 10 controls the developer unit 4. The developer unit 4 is driven into rotations based on a control instruction from the engine controller 10. When the developers 4Y, 4C, 4M and 4K are selectively positioned at a predetermined developing position which abuts on the photosensitive member 22 or is away a predetermined gap from the photosensitive member 22, toner of the color corresponding to the selected developer is supplied onto the surface of the photosensitive member 22 from a developer roller 44 disposed to the selected developer which carries toner of this color and has been applied with the predetermined developing bias. As a result, the electrostatic latent image on the photosensitive member 22 is visualized in the selected toner color.

A toner image developed by the developer unit 4 in the manner above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby rotate the intermediate transfer belt 71 along a predetermined rotation direction D2. Toner images in the respective colors on the photosensitive member 22 are superposed one atop the other on the intermediate transfer belt 71, thereby forming a color image. Further, on the sheet S unloaded from a cassette 8 one at a time and transported to a secondary transfer region TR2 along a transportation path F, the color image is secondarily transferred.

At this stage, for the purpose of correctly transferring the image on the intermediate transfer belt 71 onto the sheet S at a predetermined position, the timing of feeding the sheet S into the secondary transfer region TR2 is managed. To be more specific, there is a gate roller 81 disposed in front of the secondary transfer region TR2 on the transportation path F. As the gate roller 81 rotates in synchronization to the timing of rotations of the intermediate transfer belt 71, the sheet S is fed into the secondary transfer region TR2 at predetermined timing.

Further, the sheet S now bearing the color image is transported to a discharge tray 89, which is disposed to a top surface of the main section of the apparatus, through a fixing unit 9, a pre-discharge roller 82 and a discharge roller 83. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction along a reverse transportation path FR. While the sheet S is returned back to the transportation path F again before arriving at the gate roller 81, the surface of the sheet S which abuts on the intermediate transfer belt 71 in the secondary transfer region TR2 and is to receive a transferred image is at this stage opposite to the surface which already bears the image. In this fashion, it is possible to form images on the both surfaces of the sheet S.

On the other hand, a cleaner 76, a density sensor 60 and a vertical synchronous sensor 77 are disposed in the vicinity of the roller 75. Of these, the cleaner 76 is designed to be brought into contact with the roller 75 or to be moved away therefrom by means of an unillustrated electromagnetic clutch. As moved to the roller 75, the cleaner 76 presses its blade against a surface of the intermediate transfer belt 71 entrained about the roller 75 thereby removing the toner remaining on an outside surface of the intermediate transfer belt 71 after the secondary transfer. The vertical synchronous sensor 77 is a sensor for detecting a reference position of the intermediate transfer belt 71, thus functioning as a vertical synchronous sensor for providing a synchronous signal, or a vertical synchronous signal Vsync outputted in association with the rotating drive of the intermediate transfer belt 71. In the apparatus, operations of the individual parts thereof are controlled based on the vertical synchronous signal Vsync in order to establish synchronism of the operation timings of the individual parts as well as to superimpose the toner images of the different colors precisely on top of each other. Based on the signal Vsync, the CPU 101 adds up the count. The density sensor 60 employs, for example, a reflective photosensor. The sensor 60 faces to the surface of the intermediate transfer belt 71 so as to measure the image density of patch images which are formed onto the outer circumferential surface of the belt 71.

Further, as shown in FIG. 2, the apparatus comprises a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, etc.

In FIG. 2, denoted at 113 is an image memory which is disposed to the main controller 11, so as to store an image which is fed from an external apparatus such as a host computer via an interface 112. Denoted at 106 is a ROM which stores a calculation program executed by the CPU 101, control data for control of the engine section EG, etc. Denoted at 107 is a memory (RAM) which temporarily stores a calculation result derived by the CPU 101, other data, etc.

A reference numeral 200 represents a toner counter for determining toner consumption. The toner counter 200 calculates and stores a quantity of toner of each color consumed in conjunction with the execution of the image forming operation. The method of calculating the toner consumption is optional and any of the various known techniques may be used. For instance, the image signal inputted from the external apparatus may be analyzed to count the number of formed toner dots on a per-toner-color basis, so as to calculate the toner consumption form the count value.

The CPU 101 figures out the residual quantity of toner in each of the developers 4Y and such at each point of time by subtracting the per-color toner consumption determined by the toner counter 200 from the initial quantity of toner stored in each developer. As required, the CPU causes the display section 12 to display a message informing the user of the per-color residual toner quantity or of the occurrence of toner end.

Figure 3:
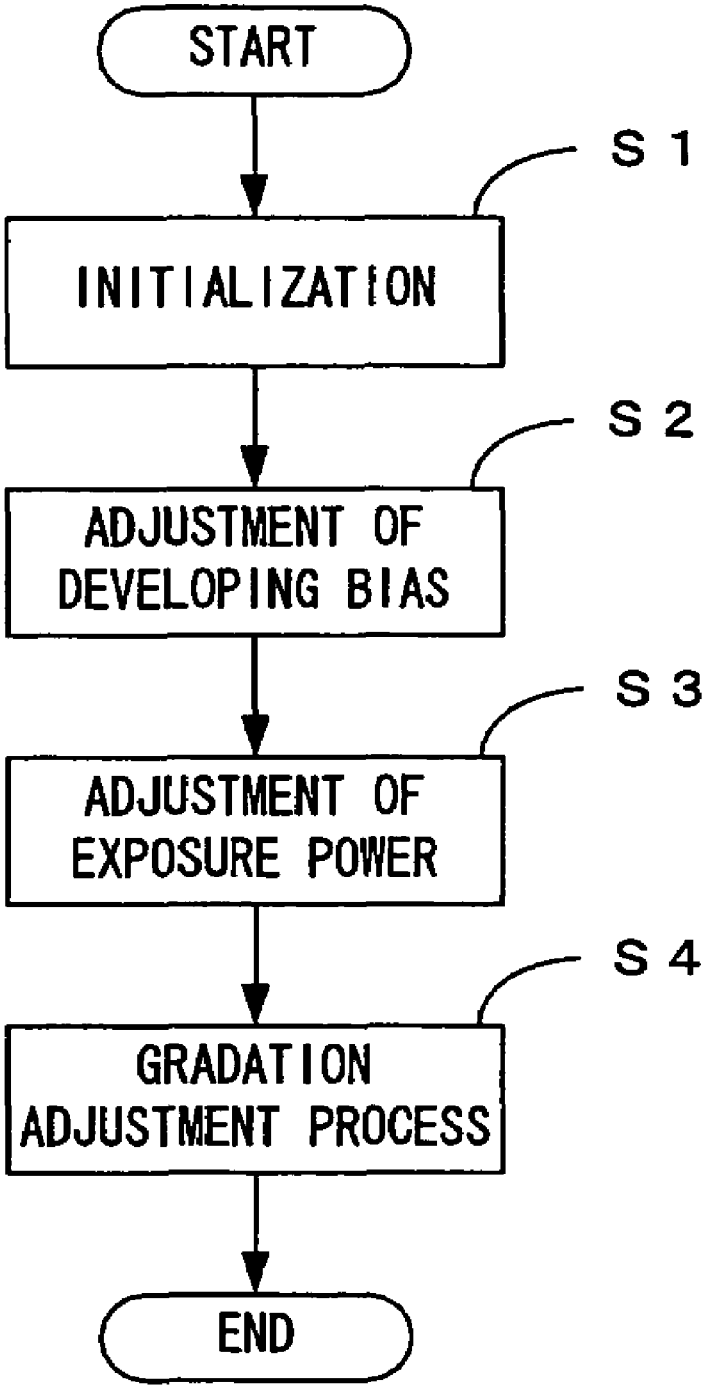
FIG. 3 is a flow chart which shows an initial adjusting operation.

FIG. 3 is a flow chart that describes an initial adjusting operation. In the apparatus that is arranged as the aforementioned, the initial adjusting operation, as described in FIG. 3 is executed at a predetermined timing, such as immediately after the power of the apparatus is turned on, immediately after recovery from sleep mode. Since many publicly known techniques exist with regard to the adjusting operation that is performed immediately after the power is turned on, a brief description of the overview of the operation will be described hereinafter.

At first, an initialization of the entire apparatus is performed (Step S1). This initialization includes: an operation to position the developer unit 4 to a predetermined home position; and a surface cleaning operations of the photosensitive member 22 and the intermediate transfer belt 71. Subsequently, an adjustment of the direct current developing bias (Step S2) and an adjustment of the power of the exposure beam L (Step S3) that is radiated from the exposure unit 6, are performed. This will optimize the operating conditions of the engine section EG. Then, a gradation adjustment process is performed to correct a gradation property against the given image signal (Step S4).

In this embodiment, in addition to the aforementioned initial adjusting operation that is performed on the occasions such as immediately after power is turned on, the adjustment of the development bias is performed whenever appropriate. In determining execution timing of the adjusting operation, the fact that the amount of charge onto the photosensitive member 22 changes over time is taken into account. The following will describe about the change in the amount of charge over time. Subsequently, the two aspects that determine processes of adjusting operation and its execution timing are explained sequentially.

Figure 4:
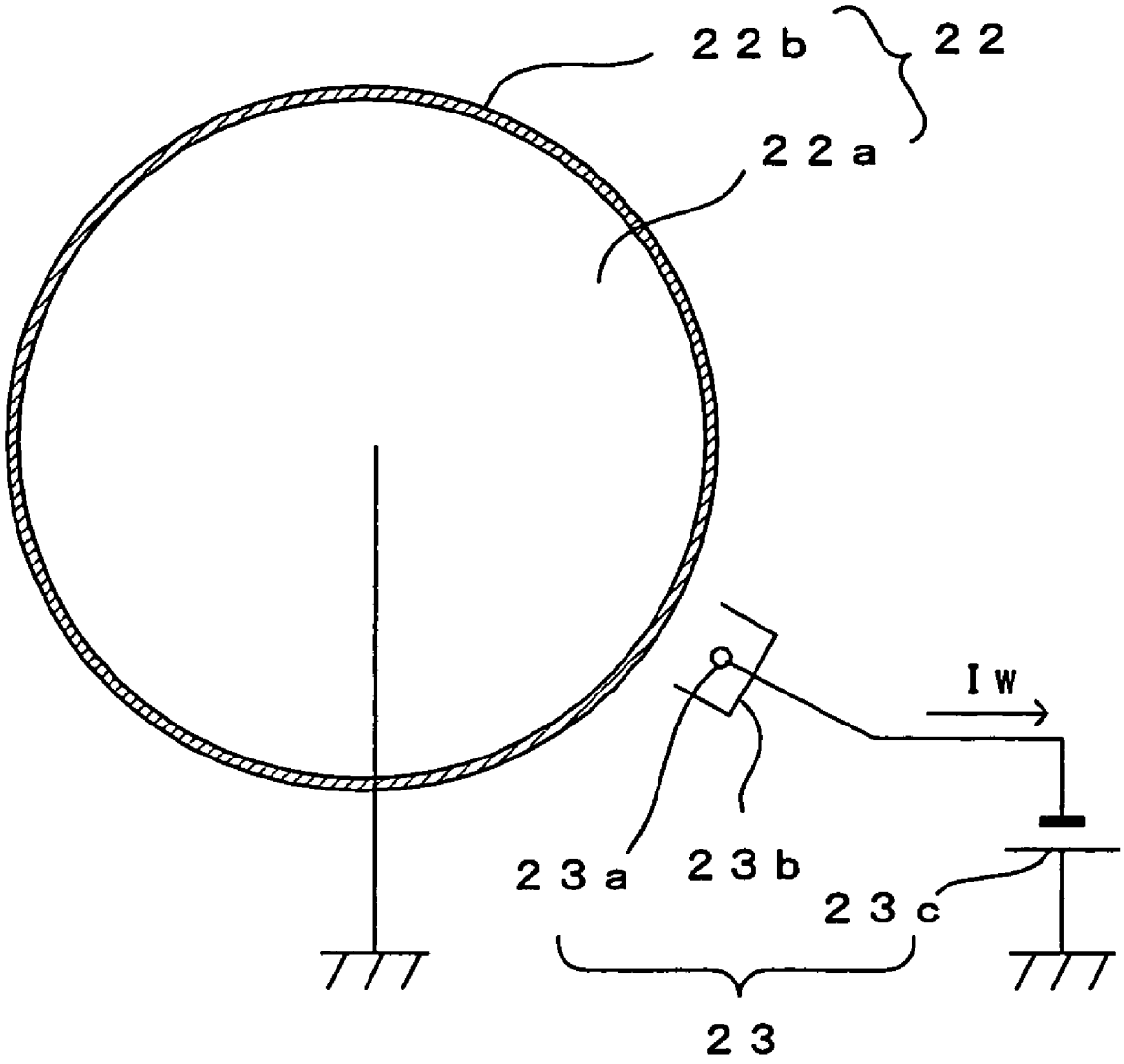
FIG. 4 is a diagram that shows a charger unit in the image forming apparatus of the first embodiment.

FIG. 4 shows the charger unit in the image forming apparatus of the first embodiment. The photosensitive member 22 comprises: a metallic roller 22*a* that is in cylinder shape and electrically grounded; and a photosensitive layer 22*b* that is mounted on the surface of the metallic roller 22*a*. The charger unit 23 charges the photosensitive layer 22*b* to a predetermined surface potential. The charger unit 23 comprises: a charger wire 23*a* that is disposed adjacent to the photosensitive member 22; a shielded electrode 23*b* that is disposed to surround the charger wire 23*a*; and a power supply 23C. When a predetermined voltage from the power supply 23*c* is applied to the charger wire 23*a*, a corona discharge occurs between the charge wire 23*a* and the photosensitive layer 22*b*, thereby charging the photosensitive layer 22*b*. During this charging process, the amount of electric current Iw, which flows through the charger wire 23*b*, is controlled by the power supply 23*c*. This electric current Iw is hereafter referred "charging current".

Figure 5:
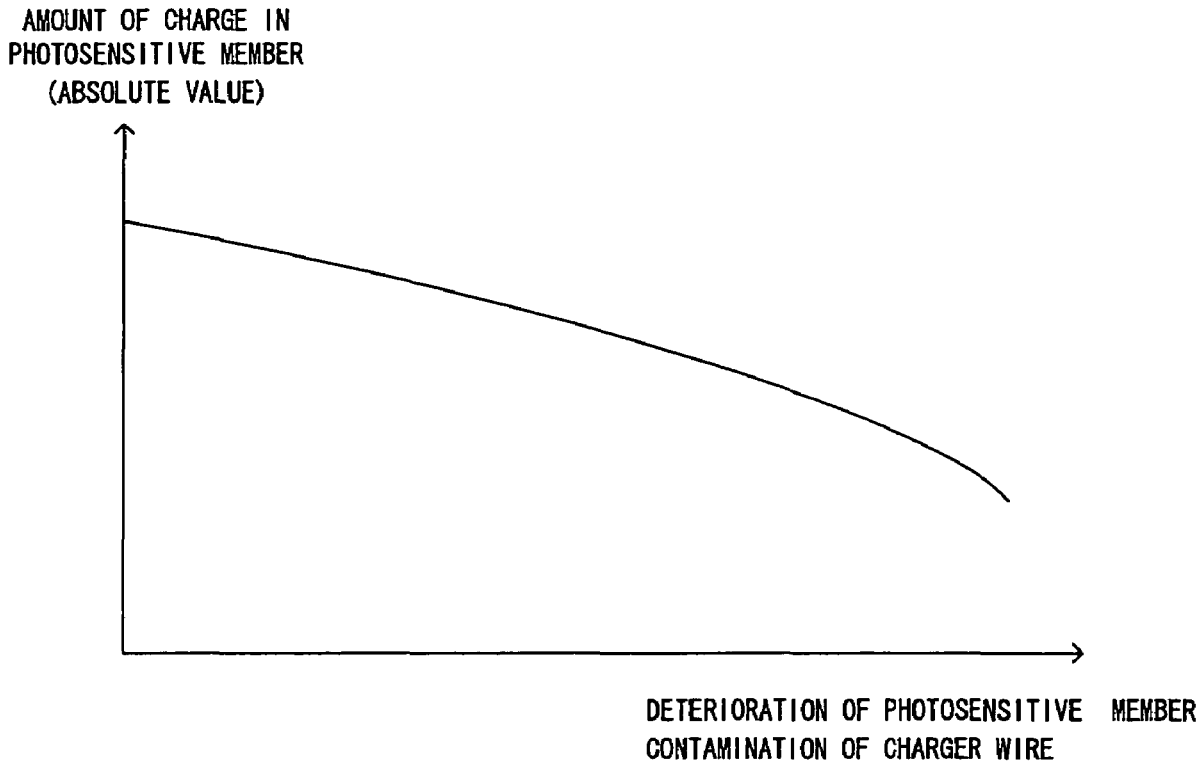
FIG. 5 is a diagram which shows charge property of a photosensitive member.

FIG. 5 shows a charge property of the photosensitive member. Even if the amount of charging current Iw is kept a constant, the amount of charge onto the photosensitive layer 22*b* changes over time due to deterioration of the photosensitive layer 22*b* and contamination of the charger wire 23*a*, as indicated by FIG. 5. Generally, the photosensitive layer 22*b* becomes thinner over time due to abrasion and the toners scatters in the apparatus, and subsequently stick to and deposit on the charger wire 23*a*. Therefore, the amount of charge (can be expressed by the charge content per unit area or by the surface potential) in the photosensitive layer 22*b* decreases gradually. In order to charge the photosensitive member 22 to the predetermined surface potential, the charging current Iw needs to be adjusted in accordance with a degree of deterioration of the photosensitive layer 22, and a degree of the contamination of the charge wire 23*a*. Also, since the amount of charge onto the photosensitive member 22 changes when the charging current Iw is changed, it is desirable to readjust the operating conditions of the apparatus.

Next, execution timing of an adjusting operation of the developing bias will be descried as follows. As mentioned above, it is desirable to determine the execution timing of the adjusting operation by taking into account the timing when the charging current Iw is changed. However, if the amount of change in the charging current Iw is known in advance, it is possible to predict a magnitude of change in the image density, which occurs subsequently, to some extent. Therefore, in the adjusting operation, which is performed in such event, it is not always necessary to adjust all the operating conditions of the apparatus, unlike the case immediately after the power supply is turned on. In this apparatus, with the consideration that changing the charging current Iw causes a change in the surface potential in the photosensitive member 22, only the developing bias is readjusted of all the operating conditions of the apparatus. In this specification, two aspects, that determine execution timing of a developing bias adjusting operation, will be descried as follows.

(First Aspect)

Figure 6:
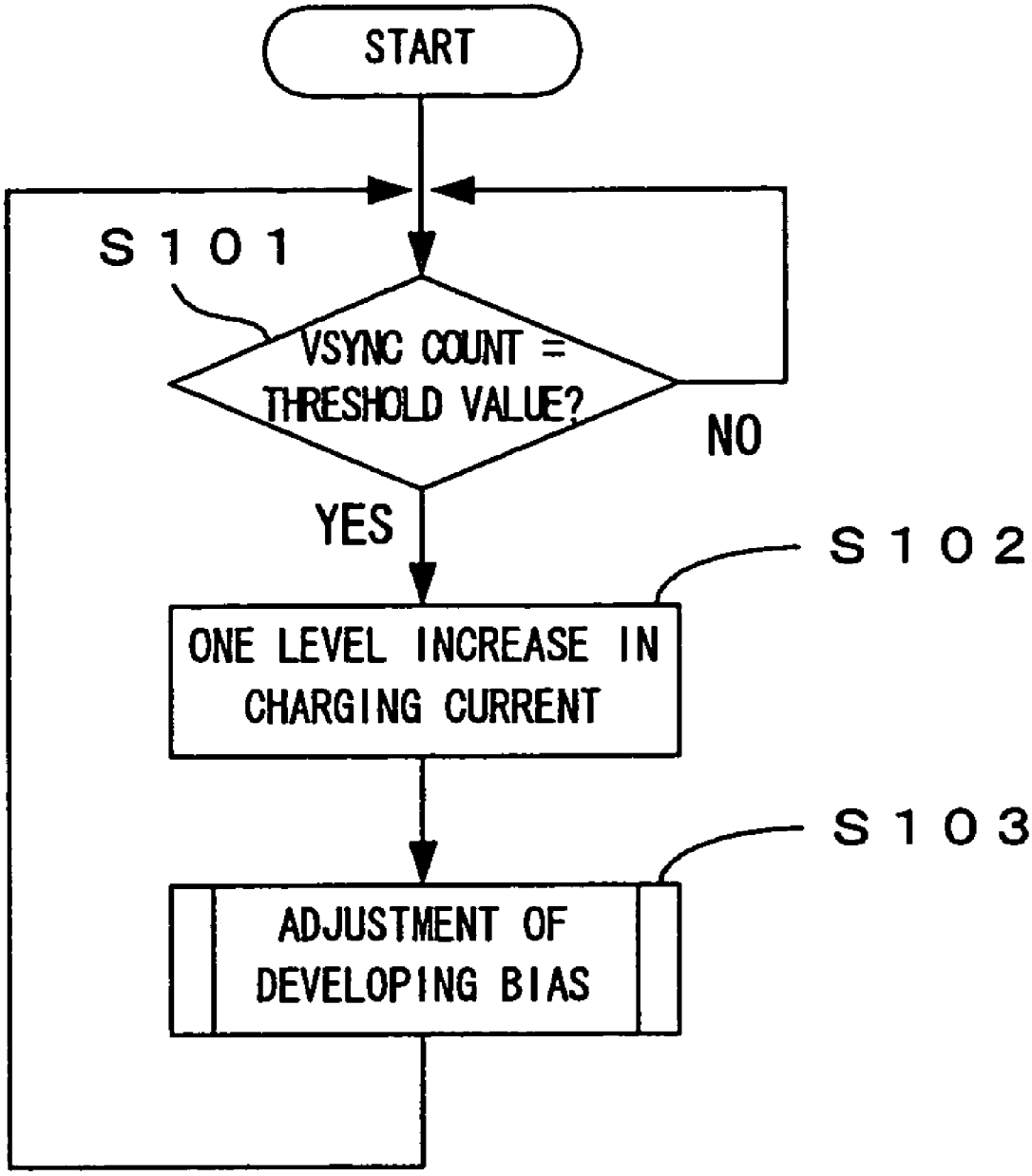
FIG. 6 is a flow chart which shows a first aspect on how to decide execution timing of an adjusting operation of the first embodiment.

FIG. 6 is a flow chart that shows the first aspect on how to decide the execution timing of the adjusting operation of the first embodiment. In this aspect, the charging current Iw is set to change based on a count of the vertical synchronizing signal Vsync, which is outputted from the vertical synchronizing sensor 77, as well as a readjustment of the developing bias. The Vsync count is a value, which directly indicates a rotation count of the intermediate transfer belt 71. However, since the charger unit 23, the photosensitive member 22 and the intermediate transfer belt 71 operate in synchronization with each other in the engine section EG, the Vsync count indirectly indicates the degree of deterioration of the photosensitive unit 22 and the degree of contamination of the charger unit 23. In fact, the Vsync count is used as information, which indicates remaining a service life of the photosensitive unit 22 or the charger unit 23.

Particularly in this apparatus, since the photosensitive member 22 and the charger unit 23 are mounted on the photosensitive member cartridge 2 in an integrated fashion, resetting of the Vsync count upon replacement of a new photosensitive cartridge will make it possible to use the Vsync count to estimate the degree of deterioration of the photosensitive member 2 and the charger wire 23*a*.

In this aspect, the adjusting operation is performed as follows. At first, the apparatus waits until the Vsync count reaches a threshold value (Step S101). Next, upon the Vsync count reaching the threshold value, a magnitude (absolute value) of charging current Iw is increased by one level (Step S102), then, adjusting operation of developing bias is executed (Step S103). As a result, change timing of the charging current Iw and execution timing of the adjusting operation will be, for example, indicated by FIG. 7.

Figure 7:
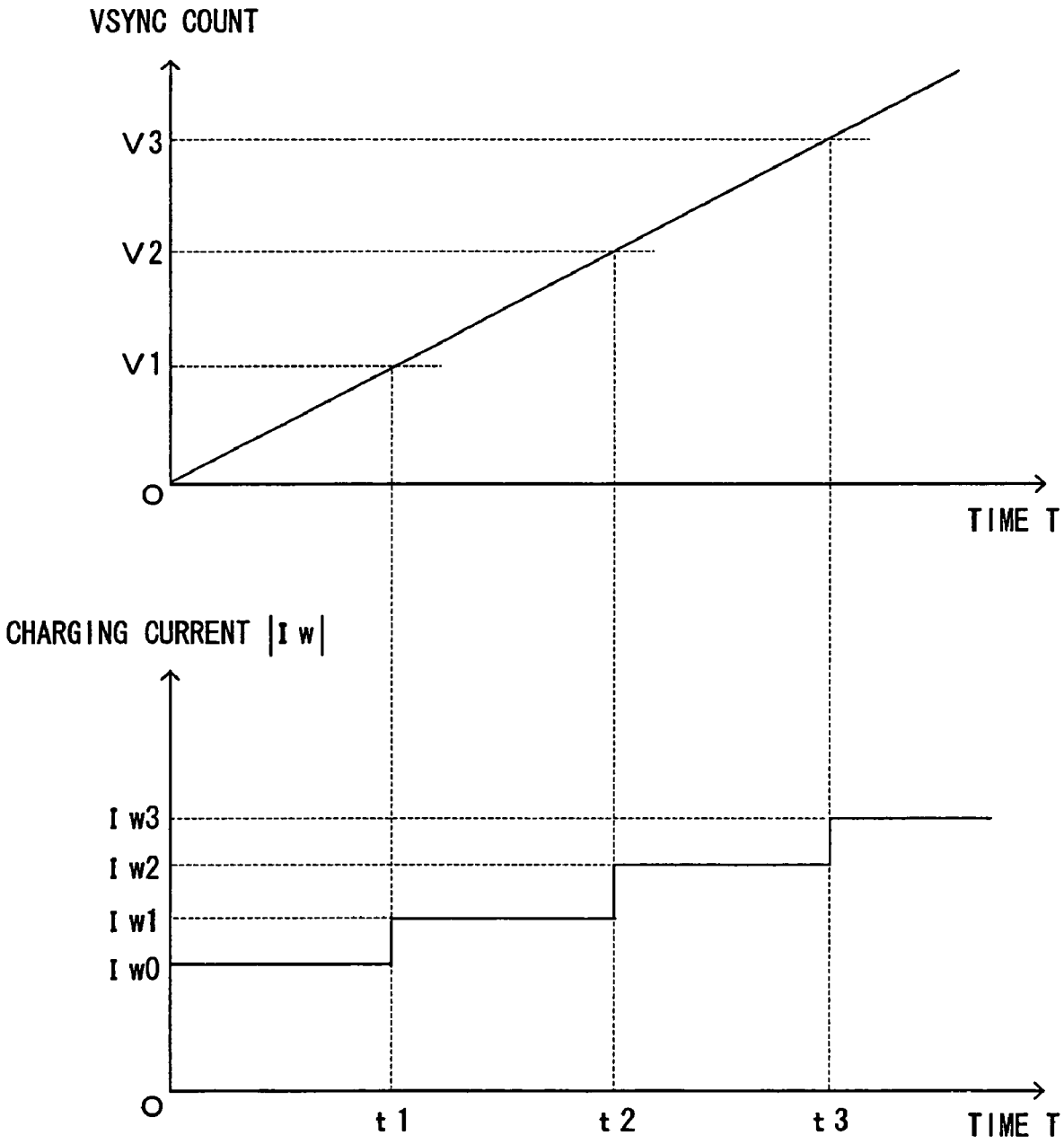
FIG. 7 is a diagram which shows a first example of the execution timing of the adjusting operation in the first embodiment.

FIG. 7 shows a first example of the execution timing of the adjusting operation in the first embodiment. As indicated by the FIG. 7, the Vsync count gradually increases over time upon when the image forming operation is repeated. Then, at a time t1 when the Vsync count reaches V1, the charging current Iw is changed from an initial value Iwo to Iw1, which is larger by one level. Similarly, at times t2 and t3, when the Vsync count reaches the threshold value V2 and V3, charging current Iw is changed to Iw2 and Iw3, respectively. Further, the adjusting operations of the developing bias are performed sequentially at times t1, t2 and t3.

Figure 8:
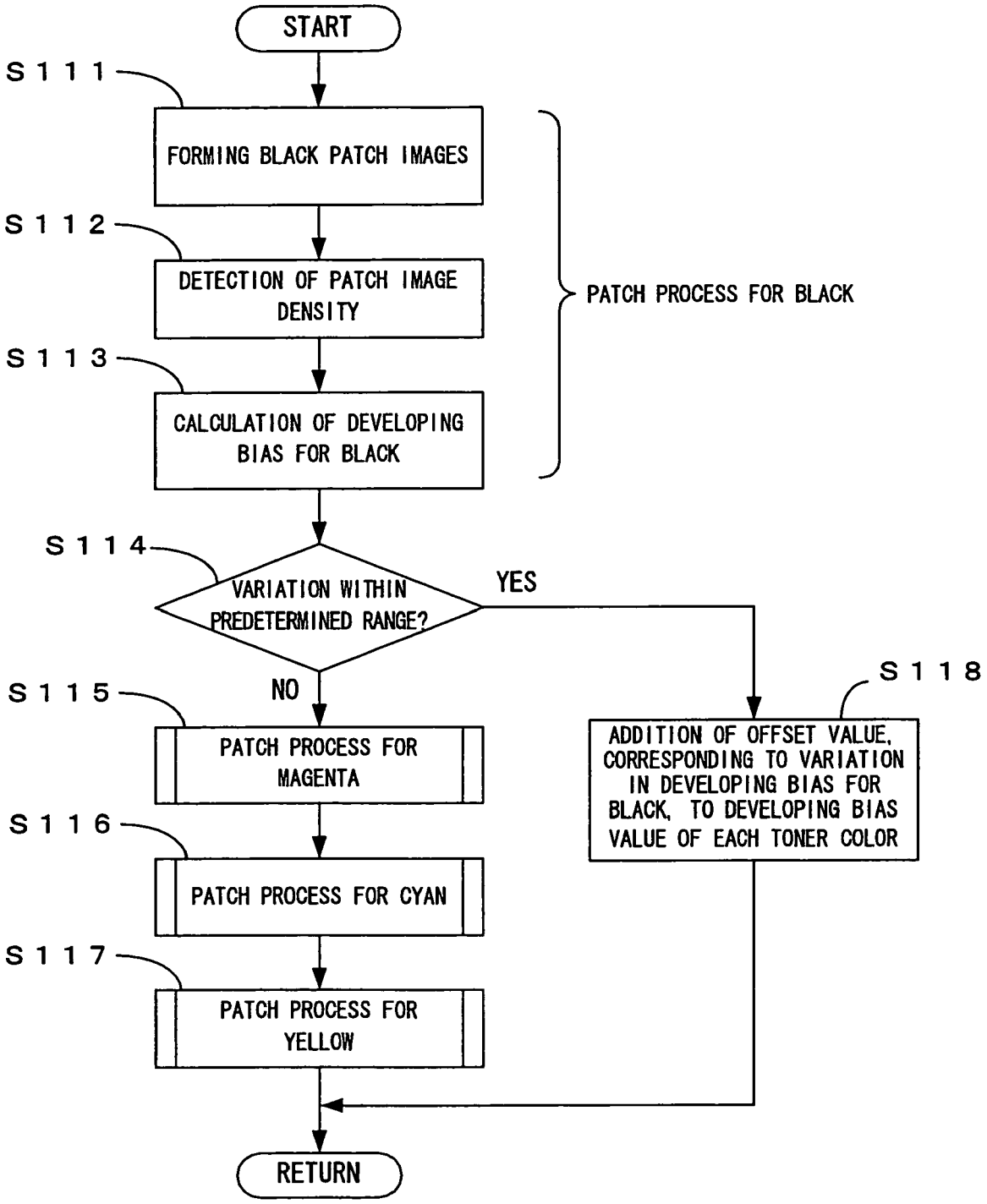
FIG. 8 is a flow chart which shows an overview of an adjusting operation of the developing bias.

FIG. 8 is a flow chart showing an overview of the adjusting operation of the developing bias. In the adjusting operation of the developing bias, a patch process for Black (K) is performed at first (Steps S111-S113). This means, the black developer 4K is positioned opposing to the photosensitive member 22, at first. Then, while the developing bias is changed to multiple varying levels, at each different developing bias a patch image having a predetermined pattern is formed (Step S111). Image density of each of the patch images that are formed, is detected with the density sensor 60 (Step S112). Based on the detecting result, an optimum value of the developing bias is calculated to ensure that the image density is consistent with a predetermined target density (Step S113).

Next, comparison is made between the optimum value of the developing bias that was newly established for the black and the value that had been set and used in the immediately preceding period (Step S114). If the difference between the two values, i.e. the variation in the optimum value of developing bias, is greater than 20V, for example, it is assumed that a deviation in the image density is relatively serious, therefore, developing biases for other toner colors should be adjusted in the same way (Steps S115-S117). This means that patch processes similar to the patch process that was performed for black color (Steps S111-S113) should be performed for each of the toner colors, i.e. Magenta (M), Cyan (C), and Yellow (Y), to calculate an optimum value of the developing bias for each color.

On the other hand, if the variation in the optimum value of the developing bias is within a predetermined value, it is assumed that deviations in the image density is relatively small, therefore a patch process for each of the toner colors such as Magenta (M), Cyan (C), and Yellow (Y), can be omitted, instead, the offset value that corresponds to the variation in developing bias for the black is added to the developing bias value of each toner color and is used as a new optimum value.

According to this embodiment, the charging current Iw is changed with respect to the Vsync count, while the readjustment of the developing bias is executed. This will ensure that the charging current Iw is adjusted appropriately in response to the changes in the charge property of the photosensitive member 22, which is caused by the deterioration of the photosensitive member 22 and the contamination of the charger wire 23*a*. Also, variation in the image density, which occur due to changes in the charge property and changes in charging current Iw, can be inhibited to ensure a stable image forming.

Further, it is possible to predict tendencies and degrees of over-time change in the charge property. Also, a degree of change in the image density incurred from a change in the charging current is not so significant given that other operating conditions of the apparatus remain unchanged. Therefore, for the adjusting operation in such case, operation process can be simplified compared with an operation which is executed when power supply is turned on. This embodiment facilitates for toner saving and process time shortening by executing the adjusting operation only for the developing bias, and omitting the adjustment processes for the exposure power and the gradation. Further, even in the adjusting operation of the developing bias, when it is assumed that the developing bias only needs small amount of change, an arrangement is made to omit some portion of the patch process for each individual color by adding an each respective offset value to the developing bias value of each toner color.

(Second Aspect)

In the second aspect, which will be described below on how to decide the execution timing of bias adjusting operation, in addition to the adjusting operation that is executed when the Vsync count exceeds the threshold value, adjusting operation is executed for other reasons when necessary. For example, when whichever one of the photosensitive member unit 2 or the four developers is replaced, operating conditions of the apparatus need to be adjusted. Also, since usage variation of the toners in the developer may cause variation in image density, operating conditions need to be adjusted, according to the usage.

Hereinafter, the description about the adjusting operation will continue based on the assumption that the adjusting operation is required when any one of the unit is replaced, or when the information that indicates a remaining service life of the developer reaches a predetermined value, or when the Vsync count reaches a predetermined threshold value. As for the information that indicates remaining service life of the developers, for example, toner usage or toner remaining amount that is calculated based on the counted value on the toner counter 200, or an integrated value of the rotation count of the developing roller 44 that is mounted on each developer, or combination of those can be used.

Figure 9:
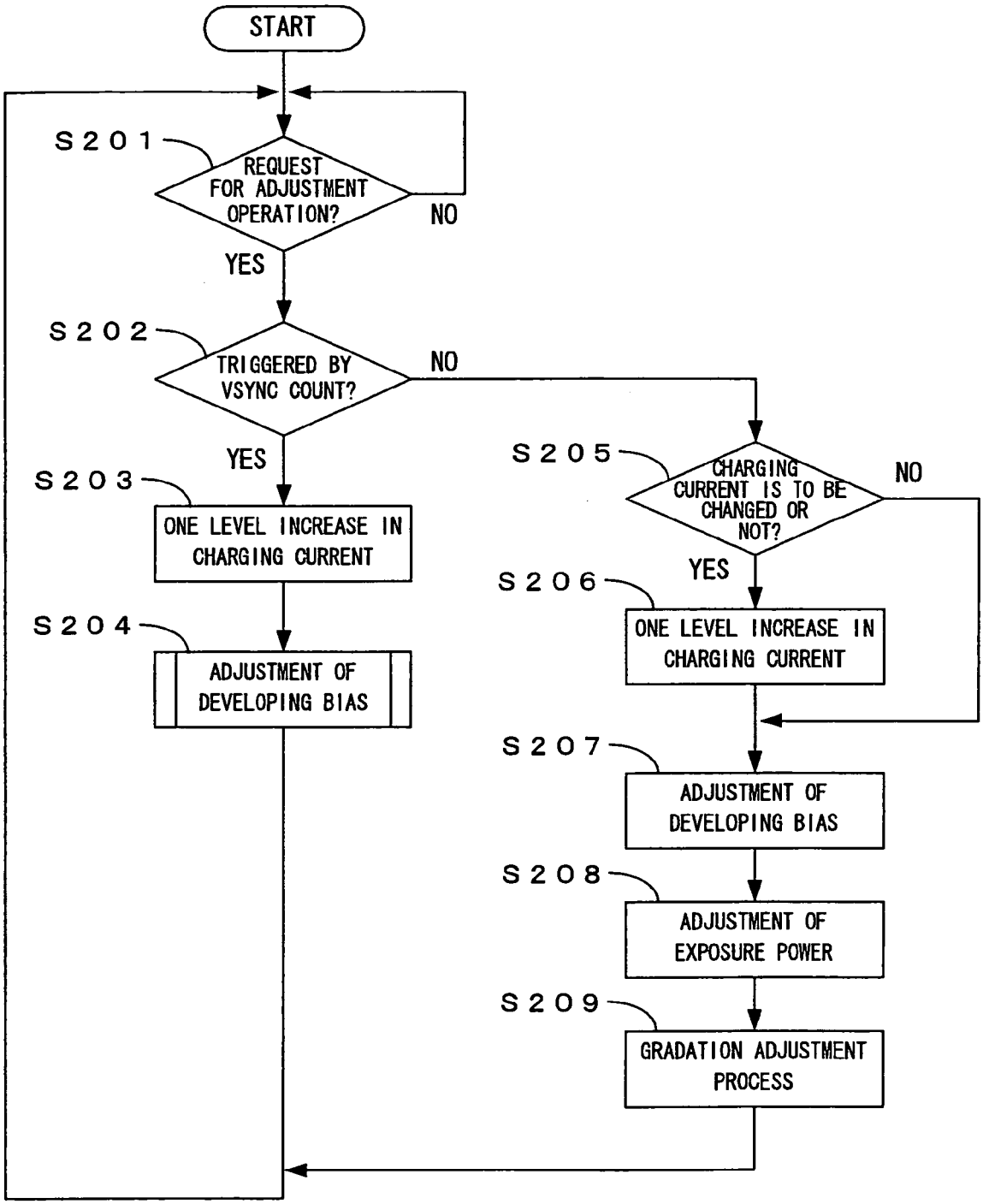
FIG. 9 is a flow chart which shows a second aspect on how to decide the execution timing of the adjusting operation of the first embodiment.

FIG. 9 is a flow chart that shows the second aspect on how to decide the execution timing of the adjusting operation of the first embodiment. In this aspect, a process is started subsequently upon request for the adjusting operation (Step S201). When the adjusting operation is requested, a judgment is made as to whether the request is triggered by the Vsync count or not (Step S202). In the event that the request for the adjusting operation is triggered by the Vsync count, that is, if the request for the adjusting operation is made because the Vsync count reaches the predetermined threshold value, the charging current Iw is increased by one level in the same way as the first aspect (Step S203), and an adjustment of the developing bias is performed subsequently (Step S204).

On the other hand, in the event that the request for the adjusting operation is not triggered by the Vsync count, that is, for example, when the adjusting operation is requested because the information on the remaining service life of the developer reaches the predetermined value, the steps S205 to S209 are to be executed. In such event, whether the charging current is to be changed or not is decided (Step S205). This decision is made based on the Vsync count at that moment, for example, in the manner described hereinafter.

If the Vsync count at that moment indicates that the time to change the charging current Iw is drawing near, the judgment is made that the charging current needs to be changed. In the event that the Vsync current has not yet reached the threshold value that indicates the time to change the charging current, but is expected to reach in the near future, the time to change the charging current Iw is assumed to come soon. For example, if the ratio of the Vsync count to the threshold value at that point is within a predetermined range (for example 80% or more and less than 100%), or the gap between the Vsync count and the threshold value is less than a predetermined value (for example, 100 counts), the Vsync count is expected to reach the threshold value in the near future. In that event, the charging current is to be changed at that moment instead of waiting for the Vsync count to reach the threshold value.

On the other hand, if the time to change the charging current Iw is predicted to be far away based on the Vsync count at that moment so that the change is not required at that moment, the charging current will not be changed. Specifically, in the event that the Vsync count does not meet the aforementioned prerequisite to the charging current change, the charging current will not be changed.

Then, if the change in the charging current is needed, the charging current Iw is to be increased by one level (Step S206), then, in the same way as the aforementioned initial adjusting operation, the adjustment of the developing bias (Step S207), the adjustment of the exposure power (Step S208), and the gradation adjustment process (Step S209) will be sequentially performed. In this case, the reason why not only the developing bias but also the other parameters are adjusted is: With regard to density fluctuations caused by the reasons other than the change of the charging current and the replacement of the units, it is in some cases difficult to predict tendency and degrees of the fluctuations. Likewise, in the adjusting operation, not triggered by the Vsync count, it is desirable to optimize the operating conditions by readjusting the parameters, which have potential to influence the image quality. Once the adjustment of the operating conditions is completed in this way, return to the step S201, and wait until the next adjusting operation is requested.

Figure 10:
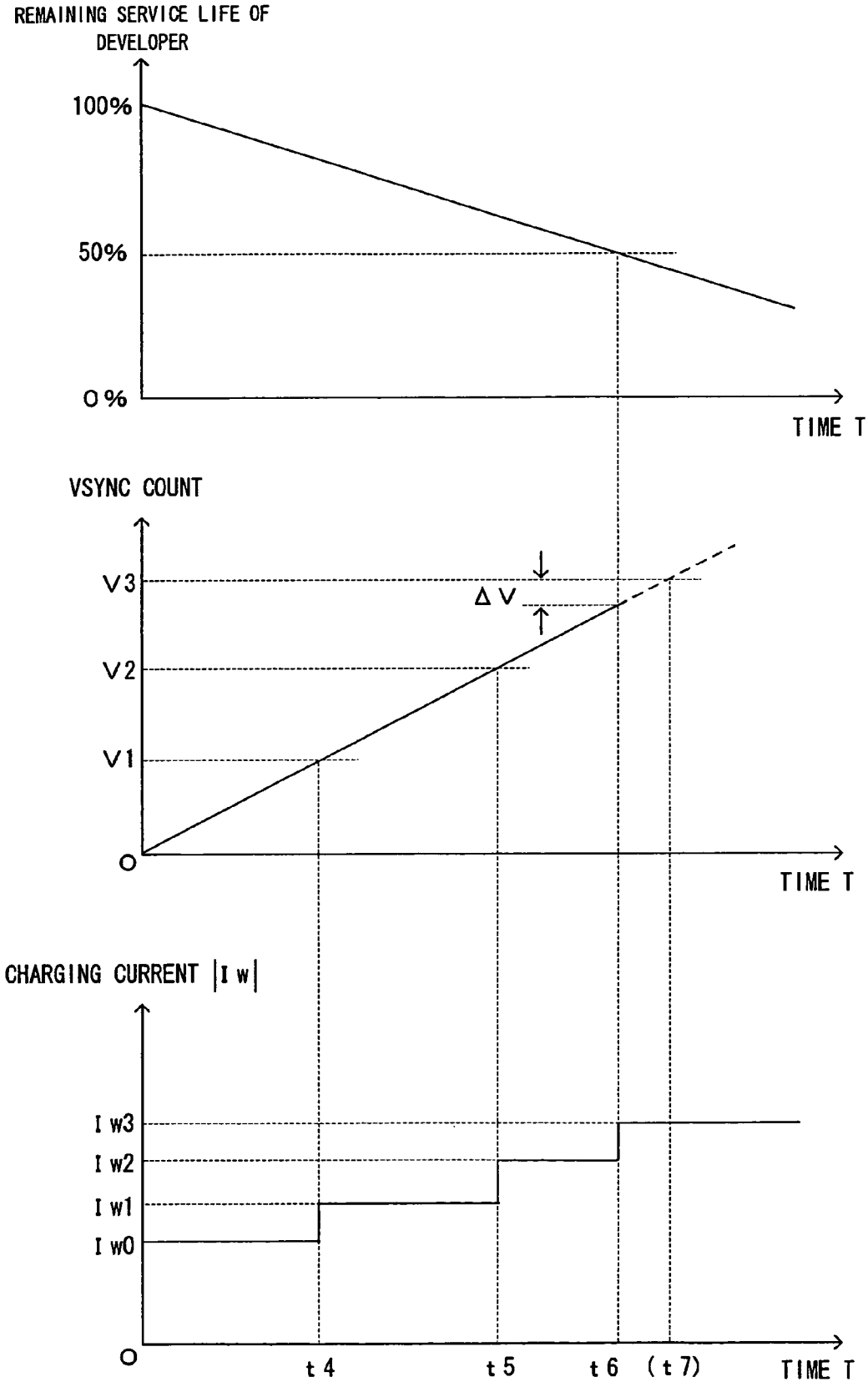
FIG. 10 is a diagram which shows a second example of the execution timing of the adjusting operation in the first embodiment.

FIG. 10 is a diagram that shows a second example of the execution timing of the adjusting operation in the first embodiment. The assumption herein is that the adjusting operation is executed when the remaining service life of any one of the developers reaches 50% level. As indicated by FIG. 10, as the developers are used, their remaining life decrease gradually from 100% at a brand new stage, to 0%, which indicates timing of exchanging any one of the developers. On the other hand, the Vsync count increases with usage. Then, at the times t4 and t5 when its value reaches the threshold value V1 and V2, the adjusting operation is requested at each respective time.

Therefore, at the times t4 and t5, the adjusting operations triggered by the Vsync count are executed. Then, it is the time t6 when the remaining service life of the developer reaches 50% that the next adjusting operation is requested. In this event, since the adjusting operation is not triggered by the Vsync count, the Vsync count at that moment is compared with the next threshold value V3. As a result, if the difference ΔV between the Vsync count and the threshold value V3 is below a predetermined value, the charging current Iw is changed at that moment ahead of schedule instead of at time t7 when the change is normally scheduled for and operating conditions are adjusted subsequently. In FIG. 10, the time t7 is in parenthesis to indicate that the adjusting operation is not executed at the time t7. The reason why is as follow.

If the adjusting operation associated with the remaining service life of the developers and the adjusting operation triggered by the Vsync count are conducted independently from each other, the following disadvantages occur. As indicated by FIG. 10, if the time difference is not so great between the time t6 when the remaining service life of the developers reaches 50% and the time t7 when the Vsync count reaches the threshold value V3, the adjusting operation is performed firstly at time t6, then, the adjusting operation is performed again at the time t7. Repeating the adjusting operation numerous times in short time does not only deliver any benefit, but also possibly causes negative effects such as wasting of toners and decrease in image forming throughput. However, it is not desirable to omit neither the adjusting operation (at the time t6) associated with remaining service life of the developers nor the adjusting operation (at the time t7) triggered by the Vsync count.

Herein, as described above, during the adjusting operation (at the time t6) associated with the remaining service life of the developers, by confirming whether the time to change the charging current drawing near or not, and if so by changing the charging current ahead of schedule, it becomes possible to combine the adjusting operations stemming from two causes. In other words, performing the adjusting operation upon changing the charging current Iw ahead of schedule at the time t6 when the remaining service life of the developers reaches 50%, omits the need for the adjusting operation at the time t7. This will prevent the adjusting operations from being performed numerously in short time. Further, if the estimate from the Vsync count at the time t6 indicates that there still is quite some time before the time to change the charging current, that is, in the event that the difference between the Vsync count and the threshold value V3 is greater than a predetermined value, it is not appropriate to change the charging current at that moment. The reason is because excessive increase in the charging current may cause the problems such as shortening the service life of the charger wires, increasing amount of ozone generated by charging, etc. In this event, it is desirable to execute the adjusting operation without changing the charging current at the time t6, then, change the charging current at the time t7 and subsequently execute the adjusting operation.

Figure 11:
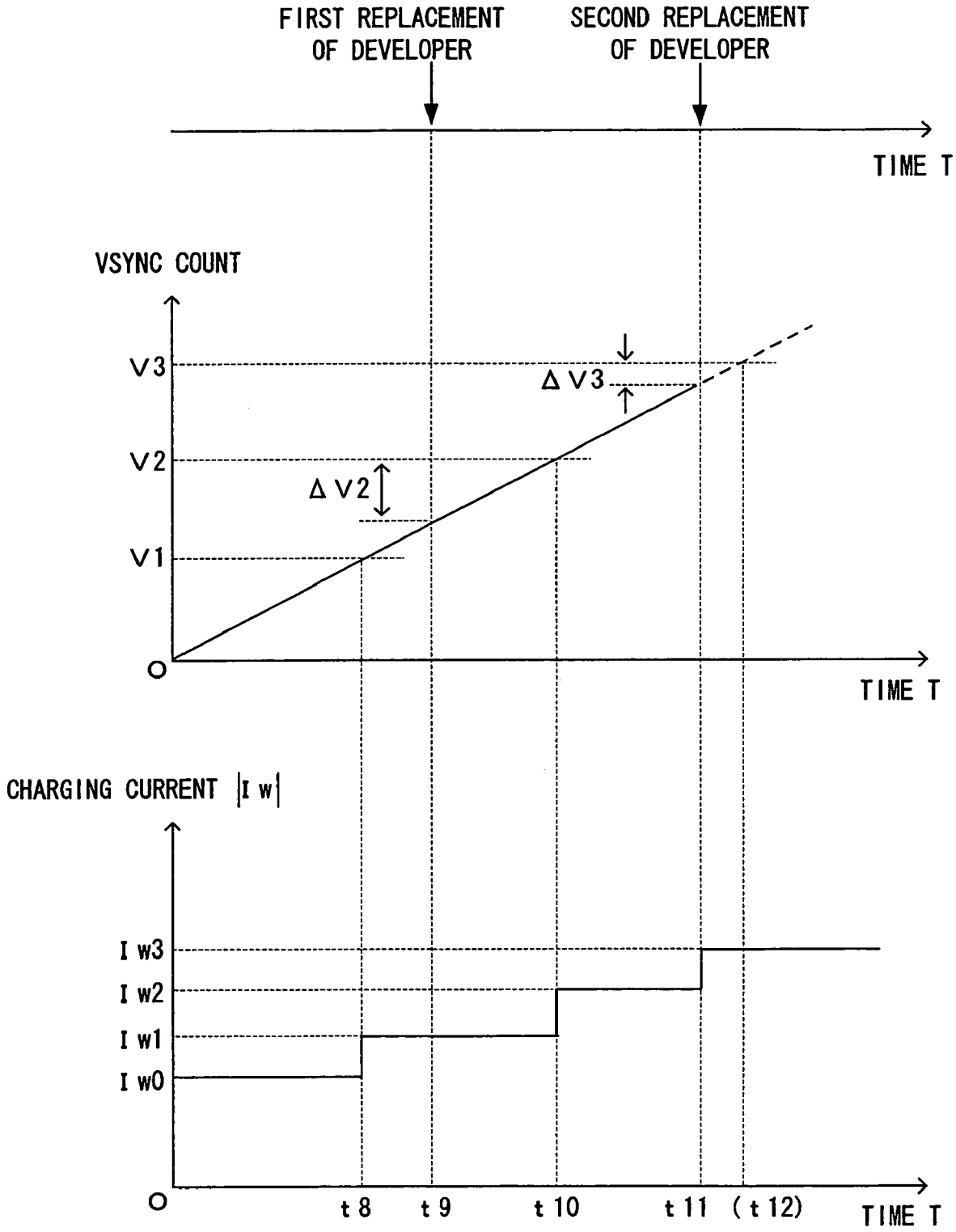
FIG. 11 is a diagram showing a third example of the execution timing of the adjusting operation according to the first embodiment.

FIG. 11 is a diagram showing a third example of the execution timing of the adjusting operation according to the first embodiment. This figure describes the case in the second aspect (FIG. 9) of this invention, when the request for the adjusting operation is triggered by the replacement of the developer. The assumption is that after the charging current Iw is changed at time t8 upon the Vsync count reaching the threshold value V1, one of the four developers is replaced at time t9. In this case, the adjusting operation is necessary since one of the developers is replaced. However, since ΔV2, the difference between the Vsync count and the threshold value V2 is great at this point, it is not necessary to change the charging current at this moment. Therefore, at the time t9, the adjusting operation is executed without changing the charging current. Then, at time t10, when the Vsync count reaches the threshold value V2, both the charging current change and the adjusting operation will be conducted simultaneously.

Subsequently, another developer is supposedly replaced at time t11. Here, if ΔV3, the difference between the Vsync count and the next threshold value V3 is below a predetermined value, the charging current that should otherwise be changed at time t12 when the Vsync count reaches the threshold value V3, is changed at this moment together with the execution of the adjusting operation. This will make it possible to omit the adjusting operation that should otherwise be conducted at the time t12. Also, since this ensures that the adjusting operation is executed whenever a developer is replaced and whenever the charging current is changed, variation of image quality can be inhibited, thereby ensuring stability in image forming.

As aforementioned, according to the first embodiment of the image forming apparatus related to the present invention, taking advantage of the fact that the value of the vertical synchronizing signal Vsync is indicative of variation in charge property of the photosensitive member 22, the operating conditions of the apparatus when the count value reaches the predetermined threshold value, the count value being generated in synchronization with the rotation of the intermediate transfer belt 71, the change in the charge property occurring due to deterioration of the photosensitive member 22 and contamination of the charger unit 23. This will ensure that the operating conditions of the apparatus is readjusted at appropriate timings, thereby ensuring the image forming at stable image quality, regardless of the change in the charge property. Further, considering that the amount of charge onto the photosensitive member 22 decreases over time due to deterioration in the photosensitive member 22 and the charger wire 23*a*, the charging current Iw is increased stepwise in accordance with the increase in the Vsync count. Since this also entails change in the amount of charge onto the photosensitive member 22, the adjusting operation is executed to ensure stability in image quality.

Further, since the amount of charge gradually increases according to the needs, there is no need to feed large amount of charge from the beginning. As a result, this embodiment makes it possible to minimize the amount of ozone generated by the electric discharge while maintaining good image quality.

Further, the adjusting operation can be executed, for example immediately after the power supply is turned on or when a unit is replaced, other than the one triggered by the Vsync count. Although it is difficult to predict the condition of the apparatus immediately after the power is turned on, etc., it is possible to predict the tendency of how the charge property of the photosensitive member 22 changes over time. Therefore, based on the prediction, the processes of the adjusting operation triggered by the Vsync count can be more simplified than the adjusting operations triggered by other reasons. This will contribute to minimize toner consumption and shorten process time.

Further, when executing the adjusting operation, not triggered by the Vsync count, and when the Vsync count at that time suggest that there soon will be the time to change the charging current, executing the change ahead of schedule and executing the adjusting operation subsequently will make it possible to omit unnecessary adjusting operation.

As described above, according to this embodiment, the photosensitive member 22 and the charger unit 23 function as the "latent image carrier" and the "charger unit" of the present invention, respectively. Further, the charger wire 23*a* mounted on the charger unit 23 corresponds to the "discharging electrode" of the present invention. Further, the engine section EG that comprises these units functions as an "image forming section" of the present invention. Further, the engine controller 10 functions as a "controller unit" of the present invention. Moreover, in this embodiment, the Vsync count, which is an integrated value of the rotation count of the intermediate transfer belt 71, corresponds to "timing information" of the present invention.

Second Embodiment

Figure 12:
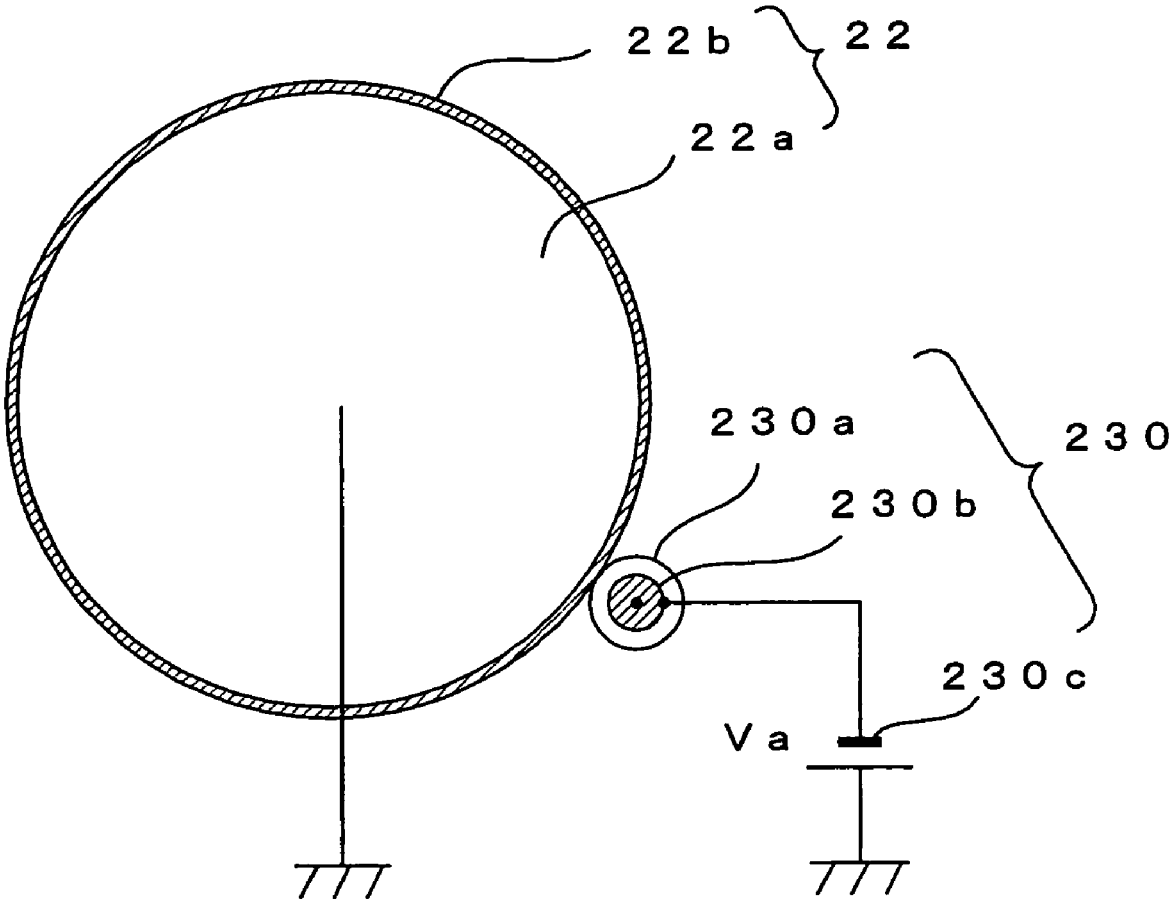
FIG. 12 is a diagram which shows a charger unit in the image forming apparatus of a second embodiment.

Next, a second embodiment of the image forming apparatus of the present invention will be descried. The greatest difference between the image forming apparatus in the first embodiment, which was described above, and an image forming apparatus in the second embodiment, which is to be described hereafter, lies with a structure of a charger unit. While the apparatus according to the first embodiment as indicated by FIG. 4 uses non-contact method to charge the photosensitive unit 22 to a predetermined surface potential with the corona charging device 23, the second embodiment as indicated by FIG. 12 uses contact charger method to charge the photosensitive member 22. Further, since the structure and the basic operations of the other parts of the apparatus are identical to those described in the first embodiment, the same structures will be simply denoted at the same or corresponding reference symbols but will not be described.

FIG. 12 is a diagram that shows the charger unit in the image forming apparatus of the second embodiment. The charger unit 230 in the second embodiment comprises: a charging roller consisting of a metallic roller 230*b* and a surface layer 230*a* that covers the surface of roller 230*b*; and a power supply 230*c* which applies a predetermined direct current bias Va to the metallic roller 230*b*. The charging roller comes into contact with the surface of the photosensitive member 22.

The surface layer 230*a*, covering the metallic roller 230*b* is made of the materials with adequate elasticity and resistivity greater than the roller 230*b*. For example, these materials, which is formed by adding conductive additive such as carbon black particles and powder of metal oxide to the elastic resin materials such as polyurethane rubber, silicon rubber, etc., can be used. Also, a surface treating layer or a coating layer can be added to a surface of the surface layer 230*a*, for the purpose of improving abrasion resistance and uncontamination for the photosensitive members.

In the charger unit 230 having the aforementioned structure, when a predetermined charging bias Va set by CPU101 is delivered from the power supply 230*c* to the metallic roller 230*b*, its voltage is applied to the photosensitive member 22 through the surface layer 230*a*, thereby charging the photosensitive layer 22*b* to a predetermined surface potential. The relationship between the charging bias Va and the amount of charge onto the photosensitive layer 22*b* varies as the thickness of the photosensitive layer 22*b* changes due to abrasion, as described hereinafter.

Figure 13:
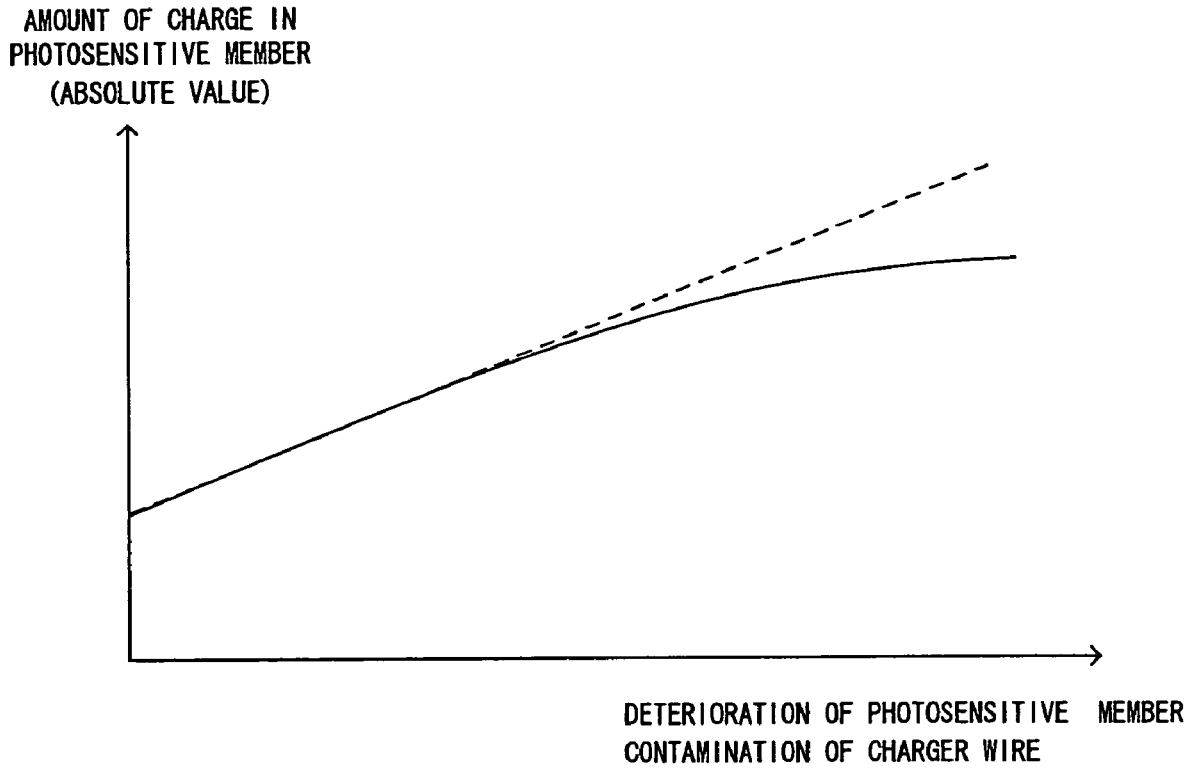
FIG. 13 is a diagram which shows charge property of a photosensitive member in the second embodiment.

FIG. 13 is a diagram showing charge properties of the photosensitive member in the second embodiment. As indicated by the embodiment, in the image forming apparatus of the contact charging system with a direct current charging bias, the observation has been made that the amount of charge increases as the photosensitive layer 22*b* becomes thinner. To be more in detail, when a film thickness of the photosensitive layer 22*b* decreases with the progression of wear, as the amount of decrease in the film thickness (hereinafter referred "film thinning amount") increases, the amount of charge onto the photosensitive member increases under the condition that the equal amount of charge bias is applied. If contamination and property deterioration in the photosensitive member 22 and the charging roller don't exist, as indicated by the dotted line in FIG. 13, the amount of charge increases as the film thinning amount in the photosensitive layer 22*b* increases. However, in the actual apparatus, since contamination and property deterioration occurs to the photosensitive member and charging roller, thereby contributing to the decrease in charge property, as described by the solid line in FIG. 13, the increase in the amount of charge tends to saturate.

As indicated above, the amount of charge onto the photosensitive member changes due to the film thinning caused by the abrasion of the photosensitive layer 22*b*. Therefore, in order to keep the surface potential of the photosensitive member constant during the image forming operation, it is necessary to change the charging bias Va according to the film thinning amount. Therefore, in this embodiment, the rotation of the photosensitive member 22 is counted up, and the charging bias Va is controlled to gradually reduce the value of charging bias Va as the counted value (hereinafter, referred "OPC count") increases.

According to this embodiment, while the OPC count is used as an indirect indicator of the film thinning amount in the photosensitive layer 22*b*, the charging bias Va is changed in order to adjust the amount of charge onto the photosensitive member 22. With regard to this point, the second embodiment uses the Vsync count as an indicator of contamination of the photosensitive members and the charger wires, thus different from the first embodiment which changes the charging current Iw for the purpose of adjusting the amount of charge onto the photosensitive member 22, nonetheless, the specific aspect of the charge adjustment is basically similar to that of the first embodiment. In other words, according to the second embodiment, the charge adjustment is achievable by replacing the Vsync count in the first embodiment with the OPC count, and by replacing the charging current Iw with the charging bias Va as a controlling target.

Figure 14:
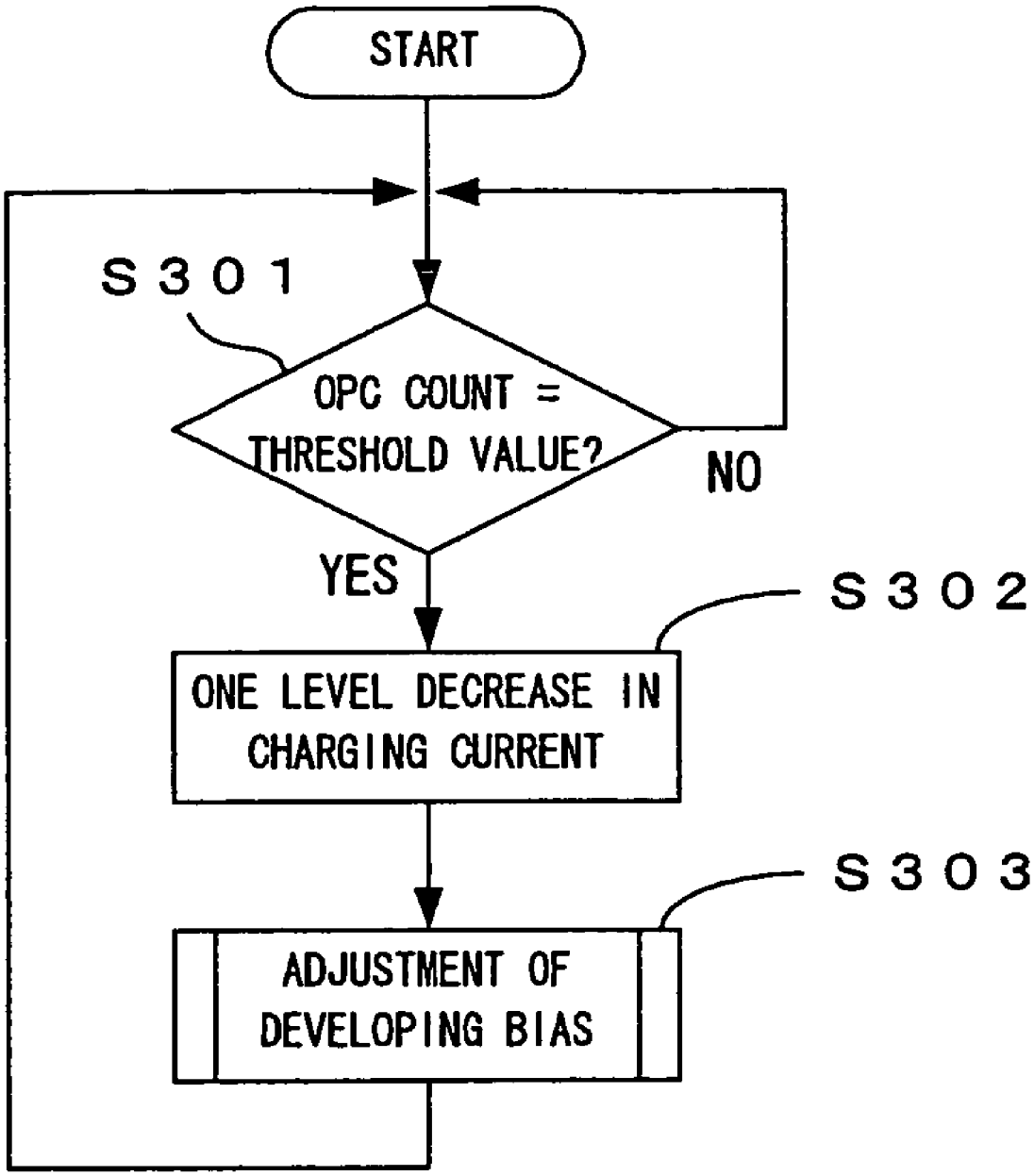
FIG. 14 is a flow chart which shows execution timing of an adjusting operation according to the second embodiment.

FIG. 14 is a flow chart which shows the execution timing of the adjusting operation according to the second embodiment. According to this embodiment, the adjusting operation is executed as follows. At first, waiting is executed until the OPC count which indicate the rotation count of the photosensitive member 22 reaches a predetermined threshold value (Step S301). Once the OPC count reaches the threshold value, the amount (absolute value) of charge bias Va is decreased by one level (Step S302), then, the adjusting operation of the developing bias is executed (Step S303). The adjusting operation of the developing bias can be same as the operation in the first embodiment (FIG. 8). As a result, the time to change the charging bias Va and the execution timing of the adjusting operation will look like those indicated by FIG. 15, for example.

Figure 15:
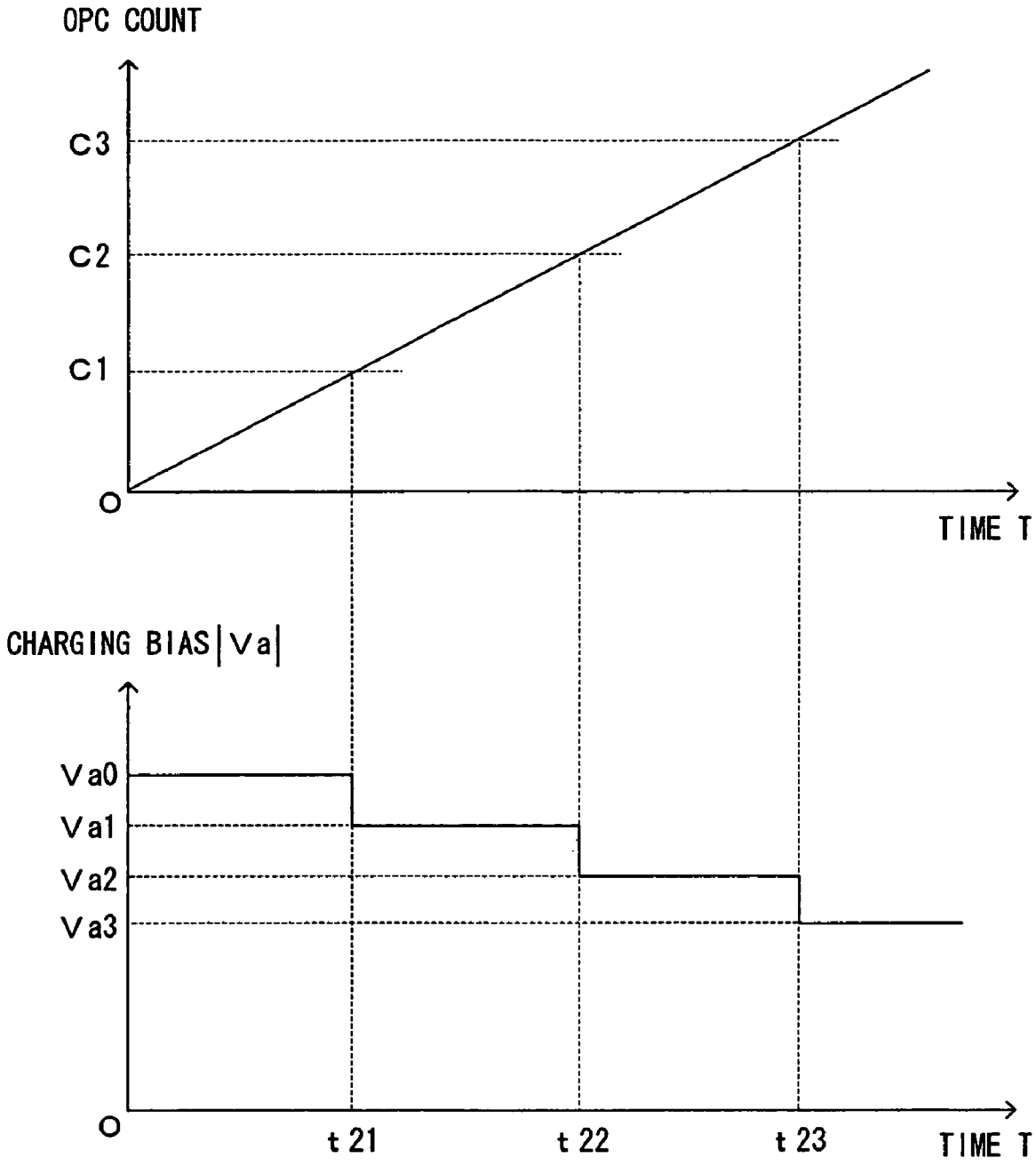
FIG. 15 is a diagram which shows a first example of the execution timing of the adjusting operation according to the second embodiment.

FIG. 15 is a diagram which shows a first example of the execution timing of the adjusting operation according to the second embodiment. As indicated by the FIG. 15, repeated image forming operations causes the OPC count to increases gradually over time. Then, at a time t21 when the count value reaches C1, the charging bias Va is changed from an initial value Va0 to one level smaller Va1. Similarly, at times t22 and t23 when the OPC count reaches the threshold value C2 and C3 the charge bias is changed to Va2 and Va3, respectively. Further, at these times t21, t22 and t23, the adjusting operations of the developing bias are executed concurrently.

FIG. 16 is a view that shows an example of adjusting the charging bias. In this image forming apparatus, the study of the relationship between the rotation count of the photosensitive member 22 and the film thinning amount has been revealed that every OPC count increase of 40,000 causes the thickness of photosensitive layer 22*b* to decrease by approximately 1 μm. Also, the study of the relationship between the thickness of the photosensitive layer 22*b* and the amount of charge has been revealed that lowering the charging bias Va by 10V at every film thickness decrease in the photosensitive layer of 1 μm will make it possible to keep the surface potential onto the photosensitive member 22 almost constant. Therefore, this embodiment has arranged to reduce the charging bias Va by 10V at every OPC count increase of 40,000. In FIG. 16, a column "bias adjustment value" represents the amount of change in the charging bias Va from the initial value Va0 at each point. In other words, for example, the preset value Va1 and Va2 at the time t21 and t22 in FIG. 15 are indicated by the following formula:

$$|Va1|=|Va0|-10\ (V)$$

$$|Va2|=|Va0|-20\ (V)$$

In the second embodiment, similar to the aforementioned first embodiment, the execution timing of the adjusting operation can be varied whenever appropriate, according to the remaining service life of the photosensitive unit 2 and the four developers and replacement status. Here, in addition to the timing that is determined by the aforementioned OPC count, the cases such as when the information that indicate the remaining service life of the developers reach a predetermined value, or when the adjusting operation is executed upon replacement of one of the units are considered. The basic operation is same as the aforementioned first embodiment (FIG. 9). However, instead of the Vsync count, the OPC count is used, and instead of the electrification count Iw, the charging bias Va is used for the controlling target.

Figure 17:
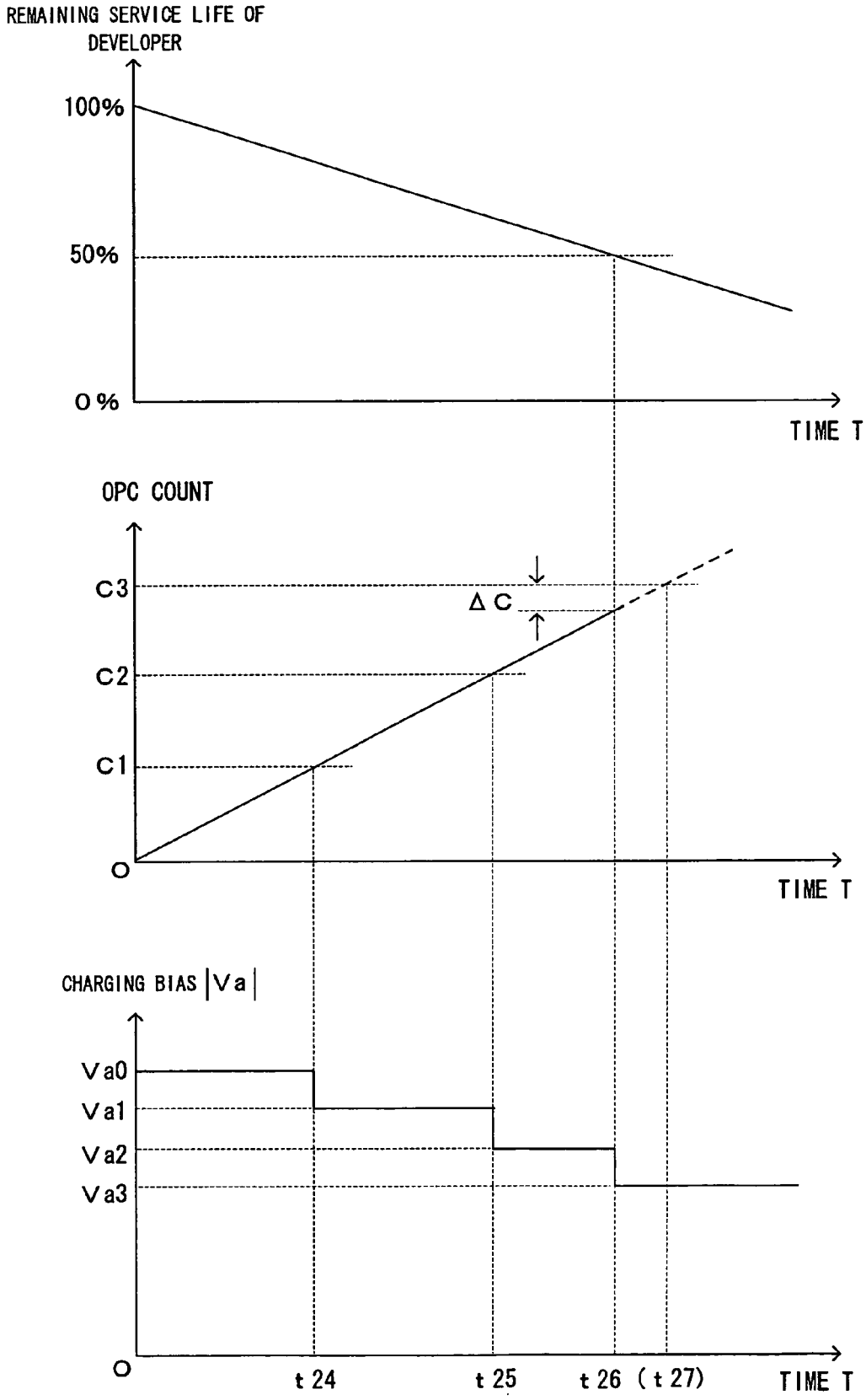
FIG. 17 is a diagram which shows a second example of the execution timing of the adjusting operation according to the second embodiment.

FIG. 17 indicates a second example of the execution timing of the adjusting operation in the second embodiment. When the OPC count reaches a predetermined value (at times t24, t25), the change of the charging bias Va and the adjusting operation are executed. On the other hand, when the execution timing of the adjusting operation which is triggered by the life of a developer arrives (at a time t26), if ΔC, the difference between the OPC count and the next threshold value C3 is below a predetermined value, in addition to the adjusting operation, the change of the charging bias Va that is suppose to be executed at a time t27 is executed at this point ahead of schedule, thereby eliminating the change in the charging bias and the adjusting operation at the time t27.

Figure 18:
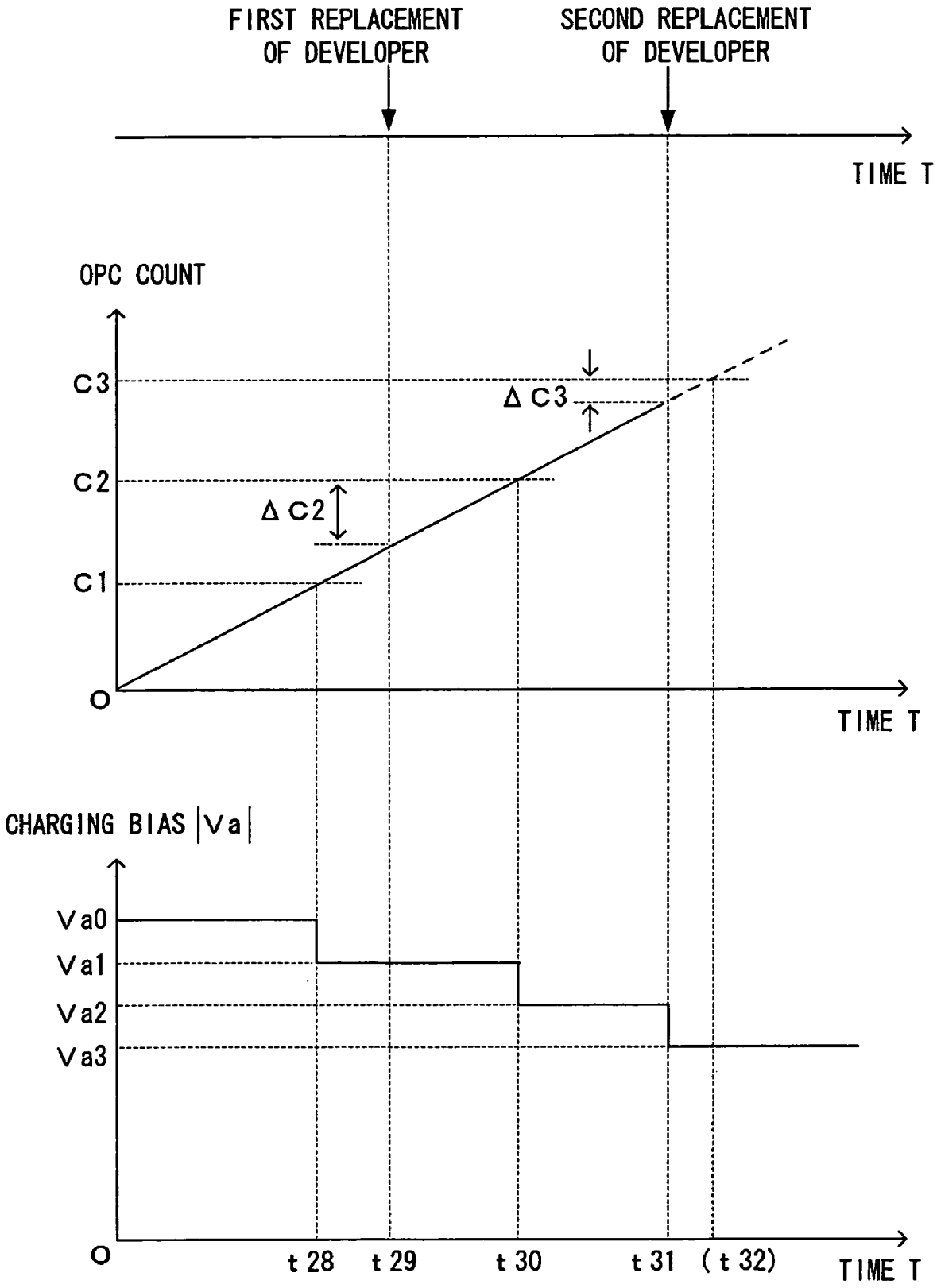
FIG. 18 is a diagram which shows a third example of the execution timing of the adjusting operation according to the second embodiment.

FIG. 18 is a diagram that indicates a third example of the execution timing of the adjusting operation according to the second embodiment. The assumption herein is; at a time t28 when the OPC count reaches the threshold value C1 and a preset value of the charging bias Va is changed form Vao to Va1, and subsequently at a time t29, one of the four developers is replaced. In this case since the developer was replaced, the adjusting operation is mandatory. However, since ΔC2, a gap between the OPC value and the threshold value C2, is great, the charging bias does not need to be changed at this point. Therefore, at the time t29, the adjusting operation is executed without changing the charging bias. Then, at a time t30 when the OPC count reaches the threshold value C2, the charging bias is changed and the adjusting operation is performed concurrently.

Further, another developer is assumed to be replaced at a time t31. At this point, if the ΔC3, the gap between the OPC count and the next threshold value Cw, is greater than a predetermined value, same as the time t28, the adjusting operation is executed without changing a charging bias. On the other hand, if the gap ΔC3 is within the predetermined value, the charging bias that should otherwise be changed at a time t32 when the OPC count is supposed to reach the threshold value C3 is changed at this moment together with the adjusting operation. This will make it possible to omit the adjusting operation at the time t32. Further, since the adjusting operation is executed when the developer is replaced and when the charge bias is changed, fluctuation in image quality is inhibited to ensure a stable image forming.

As aforementioned, the second embodiment of the image forming apparatus related to the present invention is an apparatus that charges the photosensitive member 22 to a predetermined surface potential through a contact charging system. This apparatus, in order to inhibit the fluctuation in the surface potential that is caused by an increase in the amount of charge that occurs with film thinning of the photosensitive layer 22*b*, decreases the charging bias Va as the rotation count of the photosensitive member increases. Further, when the charging bias Va is changed, the developing bias is also adjusted. In doing so, this embodiment, regardless of the film thinning of the photosensitive member, same as the apparatus in the first embodiment, can form images with stable image quality.

This invention is not limited to forgoing embodiment and various changes and modifications other than the above may be made thereto so long as such changes and modification do not deviate from the scope of the invention. For example, as "timing information", which indicates the change in the charge property of the photosensitive member 22, the forgoing first embodiment uses the Vsync count that indirectly indicates the degree of contamination and deterioration of the photosensitive member 22 and the charger wire, and the second embodiment uses the OPC count that indirectly indicates the film thinning amount in the photosensitive layer 22*b*. However, not limited to these, other information can be used as the timing information. For example, in the first embodiment, the OPC count can be used as the timing information, whereas, in the second embodiment, the V sync count can be used as the timing information. Further, in the first embodiment, the information with regard to the charger unit 23, for example, such as an integration value of the charging current can be used as the timing information.

Each of the embodiments described above executes one adjusting operation so that the operating conditions of all the toner colors be adjusted, however it is also possible to execute the adjusting operation with respect to the toner colors on need basis. In other words, upon replacement of one of the developers or upon the information on remaining service life reaching a predetermined value, the adjusting operation may be performed only on the affected toners. Further, at that moment, it is also possible to confirm the usage of the other developers, decide whether the adjusting operation should be performed or not for each of the toner colors based on the usage and perform the adjusting operation only for those toner colors in need. However, since variation in charge property of the photosensitive member 22 and change in the charging bias affect all the toner colors, it is desirable for the adjusting operation triggered by these causes be performed on all the toner colors.

Further, in the developing bias adjusting operation (FIG. 8) according to the embodiment described above, when the amount of change in the optimum developing bias for a black color is within a predetermined value, patch processes for other colors are omitted. In this case, the "predetermined value", upon which decision is made as to whether patch process for the other colors should be conducted or not, can be changed according to the situation when appropriate. For example, when the usage variations among the developers are relatively small (for example, all the developers are relatively new, etc.), the aforementioned "predetermined value" can be made relatively small, whereas, when the variation is big (when old developers and new developers coexist, etc.), as property variation among the developers is estimated at large, it is desirable to set the said "predetermined value" relatively large. Further, based on the thought that variation in charge property grows bigger as the photosensitive unit 2 grows older, it is also possible to set the "predetermined value" greater as the Vsync count becomes greater.

Further, while each of the embodiments described above applies the present invention to the apparatus that forms image by using four colors of toners, i.e., yellow, magenta, cyan and black, the types and the number of toner colors are not limited to those that are described above but arbitrary.

INDUSTRIAL APPLICABILITY

The present invention may be applied to: an image forming apparatus of rotary developing system, like the embodiments described above; and an image forming apparatus of so-called tandem system where developers corresponding to the individual toner colors are arranged in a line along the sheet transport direction, that is, the present invention can be applied to all image forming apparatus of electrophotographic system wherein an electrostatic latent image is formed by charging the surface of a latent image carrier to visualize the electrostatic latent image with a toner.

The invention claimed is:

1. An image forming apparatus comprising:

an image forming section which includes a latent image carrier which is constructed to carry an electrostatic latent image and a charger unit which charges the latent image carrier to a predetermined surface potential, wherein an electrostatic latent image, which is formed on a surface of the latent image carrier, is developed with toner to form a toner image; and a controller unit which performs an adjusting operation to adjust operating conditions of the image forming section based on a density detection result of a toner image which is formed by the image forming section as a patch image, wherein the controller unit determines execution timing of the adjusting operation based on timing information related to variation over time in charge property of the latent image carrier, the charger unit includes a discharging electrode which is closely disposed to the surface of the latent image carrier, and the controller unit controls charge property of the latent image carrier by adjusting the amount of current which is supplied to the discharging electrode based on the timing information, as well as executing the adjusting operation when the amount of current is changed.

2. The image forming apparatus of claim 1, wherein the controller unit performs the adjusting operation when the timing information reaches a predetermined threshold value.

3. The image forming apparatus of claim 1, wherein the controller unit uses information on remaining service life of the latent image carrier as the timing information.

4. The image forming apparatus of claim 3, wherein the controller unit uses an integrated value of the operation amount of the latent image carrier as the timing information.

5. The image forming apparatus of claim 1, wherein the controller unit uses information on remaining service life of the charger unit as the timing information.

6. The image forming apparatus of claim 1, wherein the controller unit executes the adjusting operation at necessary timing according to a status of individual parts of the apparatus, and process of the adjusting operation triggered by the timing information is different than if the adjusting operation were performed at a different timing.

7. The image forming apparatus of claim 6, wherein the controller unit performs a more simplified operation process for the adjusting operation which is triggered by the timing information than if the operation process were performed at a different timing.

8. The image forming apparatus of claim 1, wherein the controller unit is adapted to execute the adjusting operation at necessary timings according to a status of individual parts of the apparatus, determines whether the amount of current should be changed or not based on the timing information in the event when the adjusting operation is executed, and executes the adjusting operation after changing the amount of charging current based on the result of judgement if necessary.

9. An image forming apparatus comprising:

an image forming section which includes a latent image carrier which is constructed to carry an electrostatic latent image and a charger unit which charges the latent image carrier to a predetermined surface potential, wherein an electrostatic latent image, which is formed on a surface of the latent image carrier, is developed with toner to form a toner image; and a controller unit which performs an adjusting operation to adjust operating conditions of the image forming section based on a density detection result of a toner image which is formed by the image forming section as a patch image, wherein the controller unit determines execution timing of the adjusting operation based on timing information related to variation over time in charge property of the latent image carrier, the charger unit includes: an electrode member supplied with a predetermined charging bias; and a high-resistance layer that is disposed to cover a surface of the electrode member and is made out of materials with higher resistivity than that of the electrode member, and charges the latent image carrier with the high-resistance layer abutting the latent image carrier, and the controller unit controls charge property of the latent image carrier by adjusting the charging bias based on the timing information, as well as executing the adjusting operation when the charging bias is changed.

10. The image forming apparatus of claim 9, wherein the charging bias is DC voltage.

11. The image forming apparatus of claim 9, wherein the controller unit is adapted to execute the adjusting operation at necessary timings according to a status of individual parts of the apparatus, determines whether the charging bias should be changed or not based on the timing information in the event when the adjusting operation is executed, and executes the adjusting operation after changing the charging bias based on the result of judgement if necessary.

* * * * *